US008227726B2

(12) United States Patent
Funaki et al.

(10) Patent No.: US 8,227,726 B2
(45) Date of Patent: Jul. 24, 2012

(54) CERAMIC HEATER AND GLOW PLUG

(75) Inventors: Koji Funaki, Nagoya (JP); Yoshihito Ikai, Nagoya (JP); Yutaka Sekiguchi, Nagoya (JP); Takeshi Mitsuoka, Nagoya (JP); Yutaka Yokoyama, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 906 days.

(21) Appl. No.: 12/301,362

(22) PCT Filed: May 18, 2007

(86) PCT No.: PCT/JP2007/000534

§ 371 (c)(1),
(2), (4) Date: Nov. 18, 2008

(87) PCT Pub. No.: WO2007/135773

PCT Pub. Date: Nov. 29, 2007

(65) Prior Publication Data

US 2009/0194519 A1 Aug. 6, 2009

(30) Foreign Application Priority Data

May 18, 2006 (JP) ..... 2006-138478
Feb. 26, 2007 (JP) ..... 2007-044818
Mar. 20, 2007 (JP) ..... 2007-073013
May 18, 2007 (JP) ..... 2007-133445

(51) Int. Cl.
*F23Q 7/22* (2006.01)
*F23Q 7/00* (2006.01)

(52) U.S. Cl. ..... 219/270; 219/260

(58) Field of Classification Search ..... 219/270, 219/260–269; 123/143 R–143 C
See application file for complete search history.

(56) References Cited

U.S. PATENT DOCUMENTS

| | | | | |
|---|---|---|---|---|
| 6,049,065 | A | 4/2000 | Konishi | |
| 6,657,166 | B2 | 12/2003 | Funaki et al. | |
| 6,927,362 | B2 * | 8/2005 | Haluschka et al. | 219/270 |
| 2002/0175155 | A1 | 11/2002 | Funaki et al. | |
| 2003/0010766 | A1 * | 1/2003 | Haluschka et al. | 219/270 |
| 2006/0102611 | A1 * | 5/2006 | Reissner et al. | 219/270 |
| 2009/0194519 | A1 * | 8/2009 | Funaki et al. | 219/270 |
| 2011/0240625 | A1 * | 10/2011 | Takenouchi | 219/260 |

FOREIGN PATENT DOCUMENTS

| | | | |
|---|---|---|---|
| JP | 06-251862 | A | 9/1994 |
| JP | 10-025162 | A | 1/1998 |
| JP | 2735725 | B2 | 1/1998 |
| JP | 10-041052 | A | 2/1998 |

(Continued)

*Primary Examiner* — Daniel L Robinson
(74) *Attorney, Agent, or Firm* — Sughrue Mion, PLLC

(57) ABSTRACT

Disclosed is a ceramic heater capable of preventing failures due to the thermal stress, such as cracks, and corrosion by a calcium component. The ceramic heater has a heating element including at least one substance selected from silicides, nitrides and carbides of molybdenum and silicides, nitrides and carbides of tungsten as a main component, and a base mainly containing silicon nitride in which the heating element is embedded, wherein the base includes: a rare earth element component in an amount from 4 to 25% by mass in terms of an oxide thereof; a silicide of chromium in an amount from 1 to 8% by mass in terms of chromium silicide; and an aluminum component in an amount from 0.02 to 1.0% by mass in terms of aluminum nitride.

12 Claims, 7 Drawing Sheets

FOREIGN PATENT DOCUMENTS

| | | | |
|---|---|---|---|
| JP | 11-012040 | A | 1/1999 |
| JP | 11-214124 | A | 8/1999 |
| JP | 2001-52845 | A | 2/2001 |
| JP | 2001-206774 | A | 7/2001 |
| JP | 2002-265273 | A | 9/2002 |
| JP | 2004-296337 | A | 10/2004 |
| JP | 2005-019246 | A | 1/2005 |

* cited by examiner

CERAMIC HEATER AND GLOW PLUG

TECHNICAL FIELD

The present invention relates to a ceramic heater having a heating element including at least one substance selected from silicides, nitrides and carbides of molybdenum and silicides, nitrides and carbides of tungsten as a main component, and a base mainly containing silicon nitride in which the heating element is embedded; and a glow plug including the ceramic heater.

BACKGROUND ART

Glow plugs, which have been conventionally used for parts such as a starting aid of diesel engines, include members such as a hollow cylindrical metal shell, a stick-like center shank, a heater including a heating element inside it that heats when electrified, an insulator, an external cylinder, and a clamping member. Metal glow plugs that employ a metal sheath heater as the heater and ceramic glow plugs that employ a ceramic heater as the heater have been appropriately selected and used recently, from the viewpoint of performances required by diesel engines and costs.

A ceramic glow plug generally has the following structure: A center shank is placed on the inside of a hollow metal shell with one end of the center shank protruding from the rear end. The other end of the center shank, which is near the front end of the metal shell, is provided with a ceramic heater in the shape of a round bar. The front end of the metal shell is connected to an external cylinder, which holds the ceramic heater. In the rear end of the metal shell, an insulator is inserted in a gap between the center shank and the metal shell, and a clamping member is placed at the rear end of the insulator so that the center shank is fixed.

The ceramic heater is so constructed that a heating element including a conductive ceramic is embedded in a base made of an insulating ceramic and held in it. Various studies on materials for the heating element and base that are capable of enduring use at higher temperatures have been conducted these days. For example, the employment of a material including at least one of silicides, nitrides and carbides of molybdenum and silicides, nitrides and carbides of tungsten as the main component for the heating element has been considered. On the other hand, a material including silicon nitride as its main component is known as the material for the base.

However, generally the material for the heating element is apt to have a larger thermal expansion coefficient than the material for the base. When the difference between the thermal expansion coefficient of the former and that of the latter is large, the thermal shrinkage of the former is greatly different from that of the latter during, for example, a cooling process from a heated state to a cooled state, which may cause problems such as cracks in the base due to thermal stress. As a means to make the thermal expansion coefficient of the base closer to that of the heating element is known a method in which materials with a larger thermal expansion coefficient such as metal carbides, a typical example of which is tungsten carbide, are incorporated into the material of the base. See, for example, patent documents 1 and 2.

Patent document 1 discloses a ceramic sintered body having a matrix made of a nitride ceramic and at least one substance selected from a carbide, a silicide, a nitride and a boride of a metal that has a larger thermal expansion coefficient than the matrix, wherein the ratio of the volume of the substance to that of the matrix is from not less than 1% to less than 5%; and the ceramic sintered body has a volume receptivity of $10^8$ Ωcm or more and an insulation breaking strength at ordinary temperature of 1 kV/mm or more.

Patent document 2 discloses a ceramic heating element prepared by embedding a heating resistive body made of an inorganic conductive material in a silicon nitride sintered body including a rare earth element and silicon oxide wherein the ratio of the molar amount of the rare earth element in terms of an oxide thereof to that of silicon oxide ($SiO_2$) converted from the amount of oxygen is from 1.0 to 2.5.

Patent document 1: JP H10-25162 A

Patent document 2: JP Patent No. 2735725

Although the method mentioned above is capable of checking cracks due to the difference between the thermal expansion coefficients, there still remain the following problems. Engines have engine oil to lubricate the contact faces of metal members and reduce friction. The engine oil may permeate into the cylinder bore due to a failure of the piston ring. This permeation may cause the engine oil to adhere to the front end of the ceramic heater, which may lead to corrosion of the base near the front end of the ceramic heater by a calcium component of the oil. A fuel air mixture and a combustion gas both including an oil component, as well as the adhesion of the engine oil, may cause corrosion. When the corrosion develops, the heating element may be exposed and the oxidation thereof may grow more serious, which may ruin the function of the glow plug.

Also, when the heater that is used for, e.g. diesel engines is repeatedly exposed to a high temperature and ordinary temperature, there is a probability that the ceramic sintered body may be cracked because of the difference between the thermal expansion of the ceramic sintered body and that of the heating element and the difference between the thermal shrinkage of the former and that of the latter, or the strength of the ceramic sintered body may be lowered by movement of metal ions in the grain boundary phases due to an exposure of the ceramic sintered body to a high temperature.

In view of these problems, ceramic heaters excellent in high-temperature properties and corrosion resistance have been demanded.

DISCLOSURE OF THE INVENTION

Problems to be Solved by the Invention

The present invention was made in view of the situations explained above. The objective of the present invention is to provide a ceramic heater capable of preventing failures due to the thermal stress, such as cracks, and corrosion by a calcium component.

Means to Solve the Problems

Features appropriate to solve the aforementioned problems will be explained constitution by constitution in the followings. A description of advantages peculiar to each constitution may be added if necessary.

(Constitution 1)

The ceramic heater of this constitution has a heating element including at least one substance selected from silicides, nitrides and carbides of molybdenum and silicides, nitrides and carbides of tungsten as a main component, and a base mainly containing silicon nitride in which the heating element is embedded, wherein the base includes:

a rare earth element component in an amount from 4 to 25% by mass in terms of an oxide thereof;

a silicide of chromium in an amount from 1 to 8% by mass in terms of chromium silicide; and an aluminum component in an amount from 0.02 to 1.0% by mass in terms of aluminum nitride.

In this specification, the term "main component" means a component that accounts for the largest percent by mass of the material. The "rare earth element" includes the Group III elements including the lanthanoid elements, such as erbium (Er), ytterbium (Yb) and yttrium (Y), according to a Japanese translation of "The Recommendations 1990 by IUPAC Nomenclature of Inorganic Chemistry", translated and written by Kazuo Yamazaki and published in Mar. 26, 1993. The "rare earth element . . . in terms of an oxide thereof" is an expression based on the fact that the inventors of the present invention used oxides of rare earth elements as a material in their process of invention. Therefore the expression in question does not necessarily mean that the rare earth element component has to be always present in the form of an oxide.

The amount of an oxide of a rare earth element may be measured with a wavelength-dispersive X-ray micro-analyzer operated at an acceleration voltage of 20 kV and a spot diameter of 100 μm.

The silicide of chromium may include not only pure chromium silicide ($CrSi_2$) but also solid solutions such as a solid solution of a silicide of chromium and a silicide of tungsten, a solid solution of a silicide of chromium and a silicide of molybdenum, and a solid solution of a silicide of chromium and a silicide of vanadium. The "silicide of chromium . . . in terms of chromium silicide" is, in the same way as "rare earth element component" above, an expression based on the fact that the inventors of the present invention mainly used chromium silicide as a material in their process of invention. Although almost all the added chromium component should preferably be present in the form of the silicide, the expression does not necessarily mean that the only pure chromium silicide ($CrSi_2$) has to be present as the silicide of chromium.

The base of the ceramic heater according to constitution 1 includes a silicide of chromium in an amount from 1 to 8% by mass in terms of chromium silicide. The base should more preferably include a silicide of chromium in an amount from 1.5 to 5% by mass in terms of chromium silicide. The silicide within this range increases the thermal expansion coefficient of the base, which leads to a reduction in the difference between the thermal expansion coefficient of the heating element and that of the base. When the amount of the silicide of chromium is less than 1% by mass in terms of chromium silicide, an increase in the thermal expansion coefficient cannot be expected, which may cause cracks in the base due to thermal stress. On the other hand, if the amount of the silicide of chromium exceeds 8% by mass in terms of chromium silicide, an agglomeration of chromium components may be caused. As a result, the thermal expansion coefficient of the base is not uniform in its value part by part, which may lower the strength.

The amount of the silicide of chromium may be measured in the following way: A ceramic heater is cut at the location where the largest heat is generated, and the part around the point 100 μm under the circumferential surface of the heater on the section is measured with a wavelength-dispersive X-ray micro-analyzer. The measured value is converted into a value in terms of $CrSi_2$, which provides the amount in question.

The base of the ceramic heater according to constitution 1 further includes an aluminum component in an amount from 0.02 to 1.0% by mass in terms of aluminum nitride. The aluminum component in the specified amount controls corrosion of the base by corrosive components such as calcium components included in engine oil. When the amount of the aluminum component in terms of aluminum nitride is less than 0.02% by mass, the corrosion of the base cannot be controlled sufficiently. On the other hand, if the amount of the aluminum component in terms of aluminum nitride exceeds 1.0% by mass, the strength of the base at raised temperatures is reduced. Also, the aluminum component in the specified amount disperses aluminum atoms over the heating element while the ceramic heater is being sintered, which helps the sintering behavior of the heating element accord with that of the base. As a result, distortion caused in the sintering process can be further controlled. In addition, the value of the resistance can be stabilized.

If the feature is modified in such a way that at least a surface portion, or a surface layer portion, of the base includes an aluminum component in an amount from 0.02 to 1.0% by mass in terms of aluminum nitride, the advantages will be ensured all the more.

From the viewpoint of controlling corrosion of the base, the amount of the aluminum component should preferably be 0.2% by mass or more in terms of aluminum nitride. Glow plugs used in today's diesel engines may sometimes be exposed to such a high temperature as 1150° C., so that the purification of exhaust gas and the improvement of the horsepower will be realized. Constitution 2, which will be explained hereinafter, should be employed when more certain corrosion resistance in such a hard environment is desired.

The amount of the aluminum element in the base may be measured by appropriate methods. An example is a measurement with a wavelength-dispersive X-ray micro-analyzer followed by the conversion of the measured value to a value in terms of aluminum nitride, which is essentially the same method used for measuring the amount of a rare earth element component included in the base.

The ceramic heater according to constitution 1 is capable of enduring use under a high temperature condition, for example, use at temperatures not less than 1200° C., because the heating element includes at least one substance selected from silicides, nitrides and carbides of molybdenum and silicides, nitrides and carbides of tungsten as a main component, and a base mainly contains silicon nitride. The base of the ceramic heater according to constitution 1 also includes a rare earth element component in an amount from 4 to 25% by mass in terms of an oxide thereof. Preferably, the base should include a rare earth element component in an amount from 4 to 15% by mass in terms of an oxide thereof, more preferably in an amount from 6 to 15% by mass in terms of an oxide thereof. The rare earth element component in the specified amount improves not only sinter ability when the heating ceramic is sintered, but also the thermal expansion coefficient of the base. The latter advantage makes the difference between the thermal expansion coefficient of the heating element and that of the base smaller, which leads to the prevention of cracks in the base due to thermal stress. If the amount of the rare earth element component is less than 4% by mass in terms of an oxide thereof, there is a probability that the ceramic heater may not be sintered suitably when it is subjected to the sintering treatment. An increase in the thermal expansion coefficient of the base cannot be expected, either. There is also a probability that the thermal stress may cause cracks in the base. On the other hand, when the amount of the rare earth element component is more than 25% by mass in terms of an oxide thereof, the thermal expansion coefficient of the base is increased. However, crystalline phases of rare earth elements (RE), silicon (Si), nitrogen (N) and oxygen (O) are formed on the surface of the base and these crystalline phases lower the oxidation resistance of the base. The crystalline phases may include J-phases ($Er_4Si_2N_2O_7$), H-phases ($Er_{20}Si_{12}N_4O_{48}$) and the melilite phases ($Er_2Si_3N_4O_3$). The amount of the rare earth element component in the base may be measured by appropriate methods. An example is a measurement with a wavelength-dispersive X-ray micro-analyzer followed by the conversion of the measured value to a value in terms of an oxide thereof.

(Constitution 2)

This constitution provides the ceramic heater according to constitution 1, wherein the aluminum component is included in an amount from 0.2 to 1.0% by mass in terms of aluminum nitride.

The "aluminum component . . . in terms of aluminum nitride" is, in the same way as stated above, an expression based on the fact that the inventors of the present invention mainly used a raw material including mainly aluminum nitride (AlN), with alumina ($Al_2O_3$) also added, in their process of invention. For example, a material including $Al_2O_3$ and AlN wherein the ratio of the mass of AlN to that of $Al_2O_3$ was 3 or more was used.

In more detail, the reason that the amount of the aluminum compound is defined in terms of aluminum nitride is that aluminum nitride, and not aluminum oxide only, is mainly used as a raw material. When aluminum nitride is used as the aluminum component, the base will hardly see the formation of liquid phases at high temperatures around 1350 to 1400° C., which controls deterioration in the strength of the base per se. Both of aluminum nitride and aluminum oxide should preferably be used as the aluminum component. Compared with the use of aluminum nitride only, the combination of aluminum nitride and aluminum oxide improves the sinterability of the base, and helps the sinterability and sintering process of the heating element accord with that of the base. As a result, distortion caused during the sintering process can be controlled. In actual fact, it is also possible to use aluminum oxide only as the aluminum component. However, liquid phases are apt to be formed at high temperatures around 1350 to 1400° C. With respect to corrosion by corrosive components included in engine oil, such as calcium components, the inclusion of the aluminum component is capable of imparting corrosion resistance to the base. The use of either aluminum nitride or aluminum oxide singly provides similar or the same corrosion resistance.

The amount of the aluminum component in the base is measured by the method that was explained in relation with constitution 1.

(Constitution 3)

This constitution provides the ceramic heater according to constitution 1 or 2, wherein the base includes at least one of a silicide of chromium; a solid solution of a silicide of chromium and a silicide of tungsten; a solid solution of a silicide of chromium and a silicide of molybdenum; and a solid solution of a silicide of chromium and a silicide of vanadium.

As described in constitution 3 above, the base should preferably include at least one of a solid solution of a silicide of chromium and a silicide of tungsten (CrW)Si, and a solid solution of a silicide of chromium and a silicide of vanadium (CrV)Si. The inclusion of such a solid solution means that an agglomeration of chromium components at the interface of the heating element and the base does not take place so much. In other words, ceramic heaters including the solid solution of constitution 3 are capable of checking the thermal expansion coefficient from being not uniform over the base due to the agglomeration of chromium components, and preventing deterioration in the strength of the base. In this sense, the presence of the solid solution of a silicide of chromium and a silicide of tungsten (CrW)Si and/or the solid solution of a silicide of chromium and a silicide of vanadium (CrV)Si as the silicide of chromium is preferred to the presence of pure chromium silicide only. The ceramic heater of constitution 3 should preferably be produced by the way in which tungsten silicide ($WSi_2$) and/or vanadium silicide ($VSi_2$) are added to raw materials for the base during the process for producing the ceramic heater, more specifically the step of mixing powdery raw materials before the sintering. This addition of tungsten silicide and/or vanadium silicide leads to the formation of the solid solution(s) as described above when the heater is sintered.

(Constitution 4)

This constitution provides the ceramic heater according to any one of constitutions 1-3 explained hereinbefore, wherein the maximum particle size of the silicide of chromium at the surface portion of the base is 15 μm or less.

If the maximum particle size of the silicide of chromium at the surface portion of the base exceeds 15 μm, the ceramic heater of the present invention may see such disadvantages that particles of the silicide of chromium become prone to react with the calcium components that are a cause of corrosion and corrosion can start from the particles.

An example of the method of measuring the maximum particle size of the silicide of chromium present at the surface portion of the base is as follows: A transverse section of the ceramic heater taken at a part near the front end thereof, which emits the largest heat, is mirror-ground. The grain structures of arbitrarily selected ten spots in the area within 100 μm from the surface of the mirror-ground part of the ceramic heater are observed with a scanning electron microscope, which is often abbreviated to SEM, at 3000 magnifications. Then, the particles of the silicide of chromium are identified, and the maximum longitudinal diameter of the identified particles is regarded as the maximum particle size.

(Constitution 5)

This constitution provides the ceramic heater according to any one of constitutions 1-4 explained hereinbefore, wherein the substrate has a porosity of 5% or less.

The substrate with a porosity of 5% or less has small unevenness of the surface of the ceramic heater that is exposed to the combustion chamber, which makes it difficult for the calcium components included in engine oil to adhere to the surface. Coupled with the selection of materials for the base, the adjustment of the porosity of the base of the present invention to 5% or less, which arrests adhesion of the corrosive components to the base, remarkably improves the corrosion resistance. The adjustment of the porosity of the base to 5% or less is carried out by conventional methods. There is no limitation on the methods. Examples are a method of suitably setting conditions for sintering, including the sintering temperature and the pressing pressure, and a method of appropriately selecting the amounts of other materials, such as a binder, which are mixed with the raw materials of the base.

An example of the method of measuring the porosity is as follows: A transverse section of the ceramic heater taken at a part near the front end thereof, which emits the largest heat, is mirror-ground. The grain structures of arbitrarily selected ten spots in the area within 100 μm from the surface of the mirror-ground part of the ceramic heater are observed with a scanning electron microscope, which is often abbreviated to SEM, at 3000 magnifications. The volumetric percentage of the pores is obtained from the ratio of the area of the pores in the observed face to the area of the observed face. The volumetric percentage serves as an index of the porosity.

(Constitution 6)

This constitution provides the ceramic heater according to any one of constitutions 1-5 explained hereinbefore, wherein the ratio of the oxygen content of the rare earth element component to the total oxygen content in the base is from 0.3 to 0.6.

When the ratio of the oxygen content of the rare earth element component to the total oxygen content in the base is from 0.3 to 0.6, preferably from 0.35 to 0.50, the movement of metal ions, such as aluminum ions or rare earth metal ions, in the grain boundary phases of the base, which movement is a phenomenon due to the voltage applied to make an electric current flow the ceramic heater, can be reduced. This phenomenon may sometimes be called "migration" in this specification. The reduction in the migration is preferable because it leads to a reduction in failures such as cracks and/or breaking of wires in the ceramic heater. In more detail, when the ratio exceeds 0.6, the ceramic heater may not be sintered well by the sintering, which may result in existence of pores, and a reduction in the resistance to oxidation.

The ratio of the oxygen content of the rare earth element component to the total oxygen content in the base may be obtained in the following way: First, the total oxygen content in the base and the oxygen content of the rare earth element component are measured. Then, the ratio of the measured value of the latter to that of the former is calculated. The total oxygen content in the base may be measured by any suitable method. An example is a method including the step of pulverizing the base to obtain a powder, the step of heating and melting the powder to collect emitted oxygen gas, and the step of measuring the oxygen gas in the form of carbon monoxide gas with an infrared detector.

(Constitution 7)

This constitution provides the ceramic heater according to any one of constitutions 1-6 explained hereinbefore, wherein crystalline phases composed of a rare earth element, silicon, nitrogen and oxygen do not exist on the surface of the base.

As explained above, if crystalline phases composed of a rare earth element, silicon, nitrogen and oxygen exist in the base, especially on the surface of the base, there is a probability that the surface of the base may be oxidized, the base may be weakened, and the resistance to oxygen at high temperatures of 1000° C. or more may deteriorate. On the other hand, the base of the ceramic heater according to constitution 7 does not have crystalline phases composed of a rare earth element, silicon, nitrogen and oxygen on the surface thereof, which arrests oxidation of the surface of the base. As a result, the resistance to oxidation can be enhanced.

In this context, the surface, as well as the "surface portion" mentioned associated with constitutions 1 and 2, specifically means a surface layer of the ceramic heater that can be analyzed with a predetermined X-ray analyzer. See the description under the heading of "BEST MODE TO CARRY OUT THE INVENTION" hereinafter for further particulars.

In the present invention, the state where crystalline phases do not exist is determined in the following way: The surface of the ceramic heater is irradiated with an X-ray by the X-ray analyzer mentioned above, so that a diffraction spectrum is obtained. When the values of the maximum peaks of the respective spectra of the crystalline phases composed of a rare earth element, silicon, nitrogen and oxygen, such as J-phases, H-phases and melilite phases, are less than 5% of the value of the maximum peak of silicon nitride, the crystalline phases are considered not to be existent.

(Constitution 8)

This constitution provides the ceramic heater according to any one of constitutions 1-7 explained hereinbefore, wherein at least one of crystalline phases of a monosilicate of a rare earth element and crystalline phases of a disilicate of a rare earth element exist in the base.

As we explained in the description associated with constitution 7, the surface of the base should not have crystalline phases composed of a rare earth element, silicon, nitrogen and oxygen. On the other hand, the base should preferably have crystalline phases of a monosilicate of a rare earth element and/or crystalline phases of a disilicate of a rare earth element, as described in constitution 8. The existence of such crystalline phases improves the heat resistance and the strength of the base at high temperatures. Although the inclusion of the monosilicate crystalline phases and/or the disilicate crystalline phases in the base enhances the heat resistance of the base, those phases should be present on the surface of the base if an improvement in the strength at high temperatures is especially intended. An example of the crystal of the monosilicate of a rare earth element may be $Er_2SiO_5$, and an example of the crystal of the disilicate may be $Er_2Si_2O_7$.

The method of identifying the crystalline phases on the surface of the base may include identification with an X-ray analyzer and JCPDS cards. Although the crystalline phases of a monosilicate and/or a disilicate of a rare earth element should preferably be present on the surface of the base, it is acceptable if they exist at most at such a depth from the surface of the base that the crystalline phases can be identified from the surface of the base with an X-ray analyzer. When crystalline phases in the inner parts of the base are identified, the base should be cut, and crystalline phases in the exposed section should be analyzed and identified in the same way.

When the values of the maximum peaks of the respective spectra of the crystal of the monosilicate of a rare earth element and the crystal of the disilicate of a rare earth element are not less than 5% of the value of the maximum peak of silicon nitride, phases of the monosilicate crystal and the disilicate crystal are considered to be existent.

(Constitution 9)

This constitution provides the ceramic heater according to any one of constitutions 1-7 explained hereinbefore, wherein the base includes from 2 to 10% by volume of silicon carbide.

The base according to constitution 9 includes from 2 to 10% by volume of silicon carbide, which not only improves the sinterability when the ceramic heater is sintered, but also enlarges the thermal expansion coefficient of the base, which leads to a reduction in the difference between the thermal expansion coefficient of the heating element and that of the base. When the amount of silicon carbide is less than 2% by volume, an increase in the thermal expansion coefficient can hardly be expected and the strength at high temperatures is inhibited from increasing. On the other hand, when the amount of silicon carbide exceeds 10% by volume, there is a probability that an improvement in the sinterability during the sintering may be insufficient and the insulating properties may deteriorate.

From another viewpoint, the base that includes silicon carbide in an amount of not less than 2% by volume, preferably not less than 3% by volume to the entire volume of the base is capable of preventing cracks in the base due to thermal stress and keeping the base from a decrease in the strength thereof at high temperatures such as 1400° C. or more. When the amount of silicon carbide is less than 2% by volume, the base may see the situation in which the strength thereof decreases at high temperatures. The base may also experience an excessive thermal stress due to repeated exposures to a high temperature and ordinary temperature. On the other hand, the base with silicon carbide in an amount of not more than 10% by volume, preferably not more than 9% by volume is capable of enhancing the sinterability of the base. When the amount of silicon carbide exceeds 10% by volume, particles of silicon carbide may agglomerate, in addition to a reduction in the sinterability of the base. The agglomeration of the silicon carbide particles may make the thermal expansion coefficient of the base not uniform in its value part by part, which may result in a decrease in the strength and insulating properties of the base.

The amount of silicon carbide may be obtained in the following way: A sample of a section is prepared from a transverse section of the ceramic heater taken at a part near the front end thereof which emits the largest heat. After the section is mirror-ground, the grain structures of the mirror-ground section are observed with a scanning electron microscope, which is often abbreviated to SEM. Particles of silicon carbide are identified, and the volumetric percentage of the silicon carbide particles is obtained from the area percentage thereof.

(Constitution 10)

This constitution provides the ceramic heater according to constitution 9, wherein the maximum particle size of the particles of silicon carbide included in the base is not more than 15 μm. If the maximum particle size of silicon carbide exceeds 15 μm, the ceramic heater of the present invention may see such disadvantages that particles of silicon carbide become prone to react with the calcium components that are a cause of corrosion and corrosion can start from the particles.

An example of the method of measuring the maximum particle size of silicon carbide included in the base is as follows: A transverse section of the ceramic heater taken at a part near the front end thereof, which emits the largest heat, is mirror-ground. The grain structures of arbitrarily selected ten spots in the area within 100 μm from the surface of the mirror-ground part of the ceramic heater are observed with a scanning electron microscope, which is often abbreviated to SEM, at 3000 magnifications. Then, the particles of the silicon carbide are identified, and the maximum longitudinal diameter of the identified particles is regarded as the maximum particle size.

(Constitution 11)

This constitution provides the ceramic heater according to any one of constitutions 1-10, wherein the base has a thermal expansion coefficient from $3.3\times10^{-6}$/° C. to $4.0\times10^{-6}$/° C.

Generally, the thermal expansion coefficient of a heating element having, as a main component, at least one of silicides, nitrides and carbides of molybdenum, and silicides, nitrides and carbides of tungsten is often from about $3.7\times10^{-6}$/° C. to $3.8\times10^{-6}$/° C. According to constitution 11, the thermal expansion coefficient of the base is set to not less than $3.3\times10^{-6}$/° C. and not more than $4.0\times10^{-6}$/° C. The range of this constitution makes it possible to further reduce the difference between the thermal expansion coefficient of the heating element and that of the base, which leads to a more certain prevention of cracks in the heater caused by the thermal stress.

The thermal expansion coefficient can be adjusted by the respective amounts of the rare earth element component, the silicide of chromium and silicon carbide, which are used as raw materials when the base is formed, and the oxygen content of the base. More specifically, the thermal expansion coefficient is increased, when the amounts of the rare earth element component, the silicide of chromium and silicon carbide are increased and the total oxygen content of the base is decreased.

The thermal expansion coefficient of the base may be measured by a method having a step of raising the temperature of a standard reference sample such as quartz and that of a base to be measured from ordinary temperature to 1000° C., a step of comparing the length of the standard sample and that of the base at 1000° C. with the length of the standard sample and that of the base at ordinary temperature, and a step of calculating the thermal expansion coefficient of the base from the measured lengths.

The following constitution may also be obtained from the constitutions described hereinbefore.

(Constitution 12)

This constitution provides a glow plug having a ceramic heater according to any one of constitutions 1-11.

As stated in constitution 12, the employment of a ceramic heater, which we have explained, as its component member provides a glow plug whose ceramic heater is free from the failures described hereinbefore.

BRIEF DESCRIPTION OF THE DRAWINGS

FIG. 6(*b*) is a sectional view showing the obtained sintered body.

EXPLANATION OF REFERENCE NUMERALS

1 . . . glow plug; 2 . . . ceramic heater; 21 . . . base; 22 . . . heating element

BEST MODE TO CARRY OUT THE INVENTION

Figure 1:
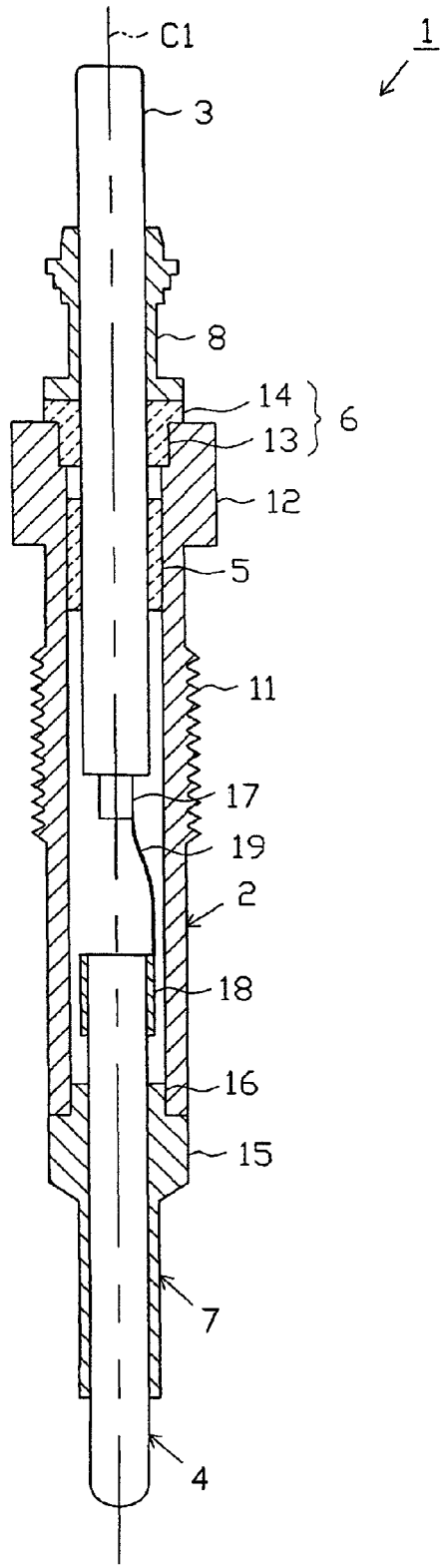
FIG. 1 is a longitudinal sectional view showing the structure of an embodiment of the glow plug.
Figure 2:
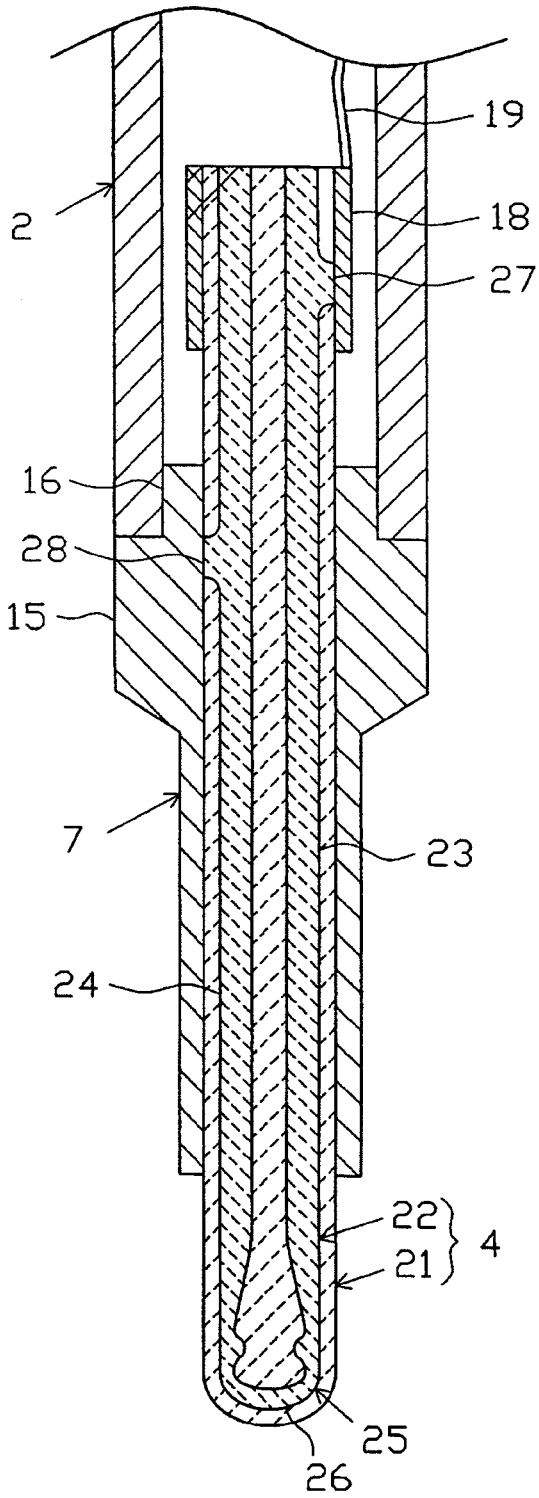
FIG. 2 is a partially enlarged sectional view of the glow plug, mainly showing a ceramic heater.

We will describe an embodiment of the present invention in the followings, referring to the figures. First, we will explain an example of a glow plug equipped with a ceramic heater according to the present invention, referring to FIGS. 1 and 2. FIG. 1 is a longitudinal sectional view of a glow plug 1, and FIG. 2 is a partially enlarged sectional view mainly showing a ceramic heater 4. In FIGS. 1 and 2, the lower side of each figure is regarded as the side of the front end of the glow plug 1 or the ceramic heater 4, and the upper side as the rear end thereof.

As shown in FIG. 1, the glow plug 1 has members such as a metal shell 2, a center shank 3, the ceramic heater 4, insulators 5, 6, an external cylinder 7, and a clamping member 8. The metal shell 2 is in the shape of a general hollow cylinder. The metal shell has an external thread part, by which the glow plug 1 is attached to the cylinder head (not shown in the figures) of an engine, at the middle of the outer circumferential face thereof. A hexagonal engaging flange 12 is formed on the outer circumferential face of the metal shell 2 at the rear end thereof. The flange engages with a tool when the glow plug 1 is screwed to the cylinder head.

The center shank 3, made of a metal and in the shape of a round bar, is placed in the inner space of a metal shell with one end of the center shank protruding from the rear end. An annular insulator 5 is disposed between the outer circumferential face of the center shank 3 and the inner circumferential face of the metal shell 2. The center shank 3 is fixed so that the central axis of the center shank 3 is aligned with the central axis of the metal shell 2 on an axial line C1. The rear end of the metal shell 2 is provided with a second insulator 6, with the center shank 3 passing through the second insulator. The second insulator 6 has a cylindrical portion 13 and a flange portion 14, and the cylindrical portion 13 is fitted into the gap between the center shank 3 and the metal shell 2. Also, the part of the center shank 3 on the upper side of the insulator 6 is inserted into the clamping member 8. The clamping member 8 is pressed from the outer circumferential face thereof and fastened up, with its front face abutting the flange portion 14. This fastening structure makes fixed the insulator 6 inserted between the center shank 3 and the metal shell 2, and prevents the insulator from slipping off the center shank 3.

An external cylinder 7 made of metal is connected to the front end of the metal shell 2. In more detail, the external cylinder 7 has a thick-walled portion 15 on the side of the rear end, and a stepwise engaging portion 16 formed in the outer circumferential face of the thick-walled portion 15 at the rear end side thereof. The stepwise engaging portion 16 is inserted into the inner space of the front end of the metal shell 2.

The center shank 3 is provided with the ceramic heater 4 on the front side thereof. The ceramic heater 4 has a base 21 and a heating element 22 (See FIG. 2). The base 21 is in the shape of a round bar whose front end is finished so as to have the shape of a curved surface. The base 21 holds the heating element 22 in the shape of a long and narrow U in a state that it is embedded in the base. The outer circumferential face of the body of the ceramic heater 4 is held by the external cylinder 7. The portion of the ceramic heater 4 to the rear of the external cylinder 7 is apparently housed in the metal shell 2. However, the ceramic heater 4 is firmly positioned by the external cylinder 7, which keeps the portion of the ceramic heater in the metal shell from touching the metal shell 2.

The front end of the center shank 3 is formed as a small-diameter portion 17. The small-diameter portion is located at the general middle of the metal shell 2 longitudinally. An electrode ring 18 is placed on the rear end of the ceramic heater 4, and the electrode ring 18 is connected with the small-diameter portion 17 of the center shank 3 by a lead wire 19 so that the former electrically communicates with the latter.

We will explain details of the ceramic heater 4, referring mainly to FIG. 2. The ceramic heater 4 is made of an insulating ceramic. The heater has a base 21 extending along the axial line C1 in the shape of a round bar with approximately the same diameter all over it. The base holds a heating element 22 in the shape of a long and narrow U in a state that it is embedded in the base. Materials for these elements will be described in detail herein after. The heating element 22 is provided with a pair of lead portions 23, 24 and a coupling portion 25 that couples the front end of the lead portion 23 and that of the lead portion 24. This coupling portion, especially a portion on the front side of the coupling portion 25 is a heating portion 26. The heating portion 26 serves as a so-called exothermic resistor. The heating portion is located in the front end of the ceramic heater 4 with the curved surface, and in the shape of a general U adapted to the curved surface. In this embodiment, the cross-sectional area of the heating portion 26 is smaller than the cross-sectional areas of the lead portions 23, 24, so that the heating portion 26 mainly generates heat when an electric current is applied.

The lead portions 23, 24 are connected to the respective ends of the coupling portion 25, and extend generally parallel with each other toward the rear end of the ceramic heater 4. A first electrode terminal 27 projects from one lead portion 23 radially outward at a location near the rear end of the lead portion, and is exposed to the outer circumferential face of the ceramic heater 4. In the same way, a second electrode terminal 28 projects from the other lead portion 24 radially outward at a location near the rear end of the lead portion, and is exposed to the outer circumferential face of the ceramic heater 4. The first electrode terminal 27 of the one lead portion 23 is located nearer to the rear end of the ceramic heater 4 along the longitudinal axis thereof or the axial line C1, compared with the second electrode terminal 28 of the other lead portion 24.

The exposed end of the second electrode terminal 28 contacts the inner circumferential face of the external cylinder 7, which allows the external cylinder 7 to electrically communicate with the lead portion 24. The electrode ring 18, which have been mentioned hereinbefore, is located so as to meet the exposed end of the first electrode terminal 27. The first electrode terminal 27 contacts the inner circumferential face of the electrode ring 18, which allows the electrode ring 18 to electrically communicate with the lead portion 23. In other words, the center shank 3 electrically connected with the electrode ring 18 through the lead wire 19, and the metal shell 2 fitted onto the external cylinder 7 and electrically connected with it serve as an anode and a cathode to apply an electric current to the heating portion 26 of the ceramic heater 4 in the glow plug 1.

The heating element 22 of the ceramic heater 4 according to this embodiment is mainly made of at least one of silicides, nitrides and carbides of molybdenum, and silicides, nitrides and carbides of tungsten. Needless to say, the raw materials for the heating element may include other components, such as various sintering aides. The raw materials or their composition of the heating portion 26 may be somewhat different from those or that of the lead portions 23, 24 so that the conductivity of the latter is larger than that of the former, which leads to the generation of larger heat. This design enables the heating element 22 to endure use under higher temperature conditions wherein the temperature is, for example, 1200° C. or more.

On the other hand, the base 21 is made of mainly silicon nitride, and further includes a rare earth element component in an amount from 4 to 25% by mass, preferably from 4 to 15% by mass, in terms of an oxide thereof; a silicide of chromium in an amount from 1 to 8% by mass, preferably from 1.5 to 5% by mass, in terms of chromium silicide; and an aluminum component in an amount from 0.02 to 1.0% by mass, preferably from 0.02 to 0.9% by mass, in terms of aluminum nitride. The "rare earth element component" may include erbium (Er), ytterbium (Yb) and yttrium (Y). The "rare earth element component . . . in terms of an oxide thereof" is an expression based on the fact that the inventors of the present invention used oxides of rare earth elements as a material in their process of invention. Therefore the expression in question does not necessarily mean that the rare earth element has to be always present in the form of an oxide. Also, the silicide of chromium may include not only pure chromium silicide ($CrSi_2$) in a narrow sense but also any other silicides of chromium such as a solid solution of a silicide of chromium and a silicide of tungsten, a solid solution of a silicide of chromium and a silicide of molybdenum, and a solid solution of a silicide of chromium and a silicide of vanadium. The "silicide of chromium . . . in terms of chromium silicide" is, in the same way as "rare earth element component" above, an expression based on the fact that the inventors of the present invention mainly used chromium silicide as a material in their process of invention. Although almost all the added chromium component should preferably be present in the form of chromium silicide, the expression does not necessarily mean that the only pure chromium silicide ($CrSi_2$) has to be present as the silicide of chromium. Furthermore, the "aluminum component . . . in terms of aluminum nitride" is, in the same way as stated above, an expression based on the fact that the inventors of the present invention mainly used a raw material including mainly aluminum nitride (AlN) in addition to alumina ($Al_2O_3$) in their process of invention. For example, a material including $Al_2O_3$ and AlN wherein the ratio of the mass of AlN to that of $Al_2O_3$ was 3 or more was used.

In particular, at least a surface portion, or a surface layer portion, of the base 21 includes an aluminum component in an amount from 0.02 to 1.0% by mass in terms of aluminum nitride. In this context, "surface portion or surface layer portion" means the part where the aluminum content thereof is measured in examples that will be described hereinafter. More specifically, it means a part at 100 μm under the outer surface of the ceramic heater.

As mentioned hereinbefore, the base 21 includes, as the silicide of chromium, not only pure chromium silicide ($CrSi_2$) but also at least one of a solid solution of a silicide of chromium and a silicide of tungsten, a solid solution of a silicide of chromium and a silicide of molybdenum, and a solid solution of a silicide of chromium and a silicide of vanadium. The solid solutions are formed by addition of tungsten silicide ($WSi_2$) and/or vanadium silicide ($VSi_2$) to raw materials for the base 21 during the process for producing the ceramic heater 4, more specifically the step of mixing powdery raw materials before the sintering, which will be explained hereinafter.

In this embodiment, crystalline phases composed of a rare earth element, silicon, nitrogen and oxygen, such as J-phases ($Er_4Si_2N_2O_7$), H-phases ($Er_{20}Si_{12}N_4O_{48}$) and melilite phases ($Er_2Si_3N_4O_3$), do not exist in the surface portion of the base 21.

On the other hand, crystalline phases of a monosilicate of a rare earth element ($Er_2SiO_5$) and/or crystalline phases of a disilicate of a rare earth element ($Er_2Si_2O_7$) exist in the base 21 of this embodiment.

The base 21 of this embodiment further includes from 2 to 10% by volume of silicon carbide (SiC).

We have explained the constitution of the glow plug 1, especially that of the ceramic heater 4, hereinbefore. The ceramic heater 4 of this embodiment should be made by the following method. We will briefly describe the method of producing ceramic heaters 4 hereinafter, referring to FIGS. 3-6.

Figure 3:
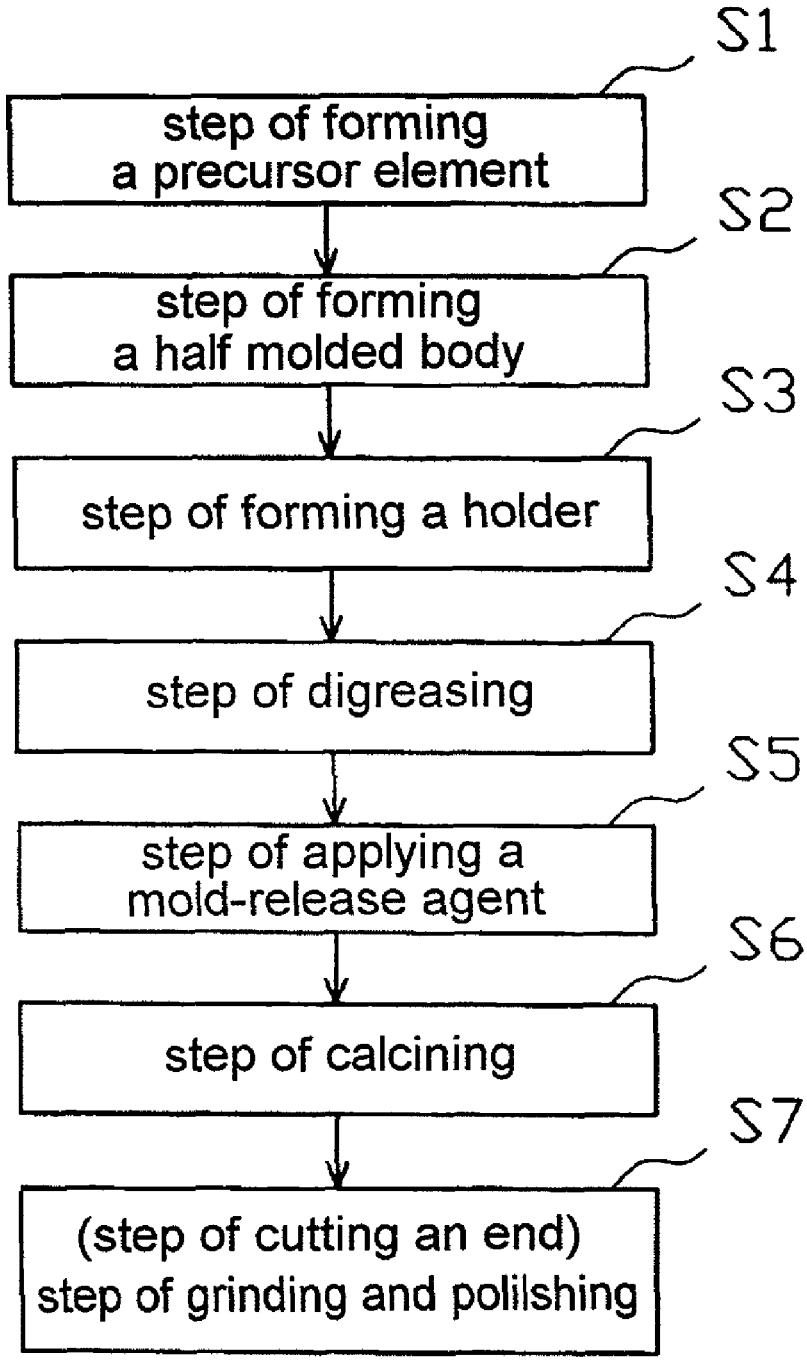
FIG. 3 is a flowchart illustrating a method of producing a ceramic heater.

FIG. 3 is a flowchart illustrating the steps of the process of producing ceramic heaters 4. The first step (S1) of the process is to form a molded body 31 for the heating element. See FIG. 4. The molded body 31 for the heating element is, so to speak, a precursor of the heating element 22. The formation of the molded body 31 for the heating element will be explained in more detail. A mixture of at least one of silicides, nitrides and carbides of molybdenum, and silicides, nitrides and carbides of tungsten as a main component, and additives such as a sintering aid, is added to water and a slurry is made. The slurry is changed to a powder by spray drying. The powder and resin chips, as a binder, are kneaded, and the obtained is injection-molded into an article. The article is preheated and dried so that part of the binder is incinerated or removed. Thus a molded body 31 for the heating element is obtained.

Figure 4:
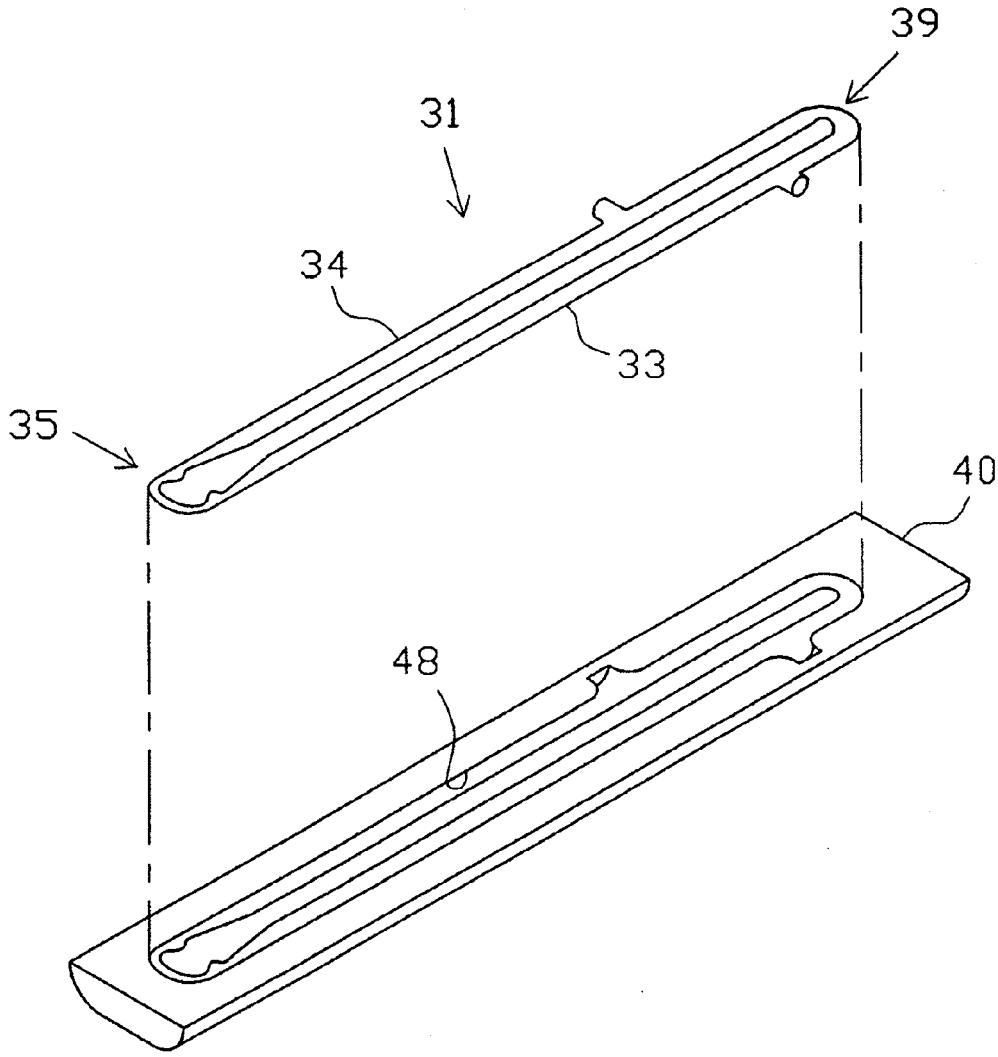
FIG. 4 is a perspective view illustrating a step of placing a molded body for a heating element in an accommodating recess formed in the upper face of a half molded body for an insulator.

As shown in FIG. 4, the prepared molded body 31 for the heating element has unsintered lead portions 33, 34, and an unsintered coupling portion 35, in the shape of a general U, which couples the front end (on the left side in the figure) of the unsintered lead portion 33 with that of the unsintered lead position 34. In this context the adjective "unsintered" means that the portions have not been sintered. In this embodiment, a supporting portion 39 that connects the rear ends of the unsintered lead portions 33, 34 with each other is integrally molded. Ceramics before being sintered has a small mechanical strength, and the coupling portion 35 is relatively narrow. Therefore there is a probability that the molded body 31 for the heating element may see failures such as cracks in it and/or breaking of it during the process. The molded body 31 for the heating element according to this embodiment is formed in the shape of a ring made by the coupling portion 35, the unsintered lead portions 33, 34, and the supporting portion 39, so that the load of the weights of the lead portions 33, 34 is distributed over the coupling portion 35 and the supporting portion, which prevents the failures of the coupling portion 35, such as breaking of it. Note that the supporting portion 39 is cut away after the sintering. Therefore from the viewpoint of ease of the cutting, the supporting portion 39 may have a smaller width than that in FIG. 4. Needless to say, it will cause no problem if the molded body for the heating element does not have the supporting portion 39.

We are returning to the explanation of the process of producing the ceramic heater 4. Apart from the molding step of the molded body 31 for the heating element, the second step to form a half molded body 40 for an insulator, which constitutes a half of the base 21, is carried out. See S2 in FIG. 3. In more detail, a powder of materials for the half molded body 40 for an insulator is prepared first. A mixture of a silicon nitride powder whose average particle size is 0.7 μm as a main component as described above, and other raw materials such as a powder of an oxide of the rare earth element component, a powder of Cr compounds such as $Cr_2O_3$.CrS with an average particle size of 1.0 μm, a powder of W compounds such as $WO_3$.$WSi_2$ and/or a powder of V compounds with an average particle size of 1.0 μm, a powder of silicon carbide with an average particle size of 1.0 μm, which has an a crystalline structure or a β crystalline structure, powdery alumina, and powdery aluminum nitride is prepared. The mixture is wet mixed in ethanol with balls made of silicon nitride for 40 hours. The resultant is dried in a water bath, and a powder or granules are obtained. The half molded body 40 for the insulator is formed from the obtained insulating ceramic powder.

A predetermined mold assembly (not shown in the figures) is used to mold the half molded body 40 for the insulator. The mold assembly has a frame in the shape of, for example, a typical frame with a rectangular opening viewed from the top thereof, a top force and a bottom force that are movable in relation to the frame. The projecting part of the bottom force is inserted into the opening of the frame, and the opening is filled with a predetermined amount of the insulating ceramic powder. Then, the top force is moved down and pressing under a predetermined pressure is carried out. As a result, a half molded body 40 for the insulator with a housing recess 48 formed therein, as shown in FIG. 4, is obtained. Either of the molding step (S1) of the molded body 31 for the heating element and the molding step (S2) of the half molded body 40 for the insulator may precede the other.

Figure 5:
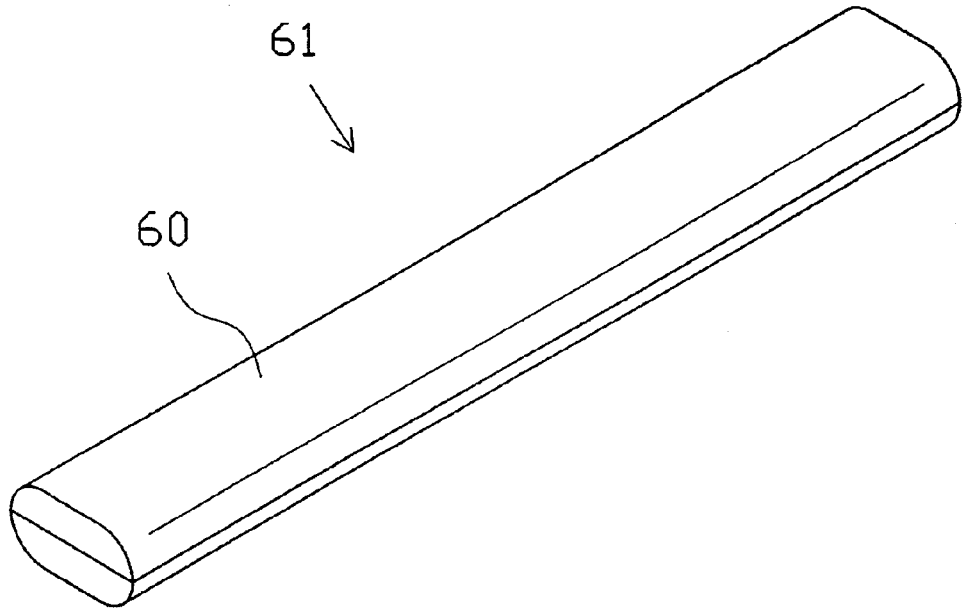
FIG. 5 is a perspective view showing a holder.
Figure 6:
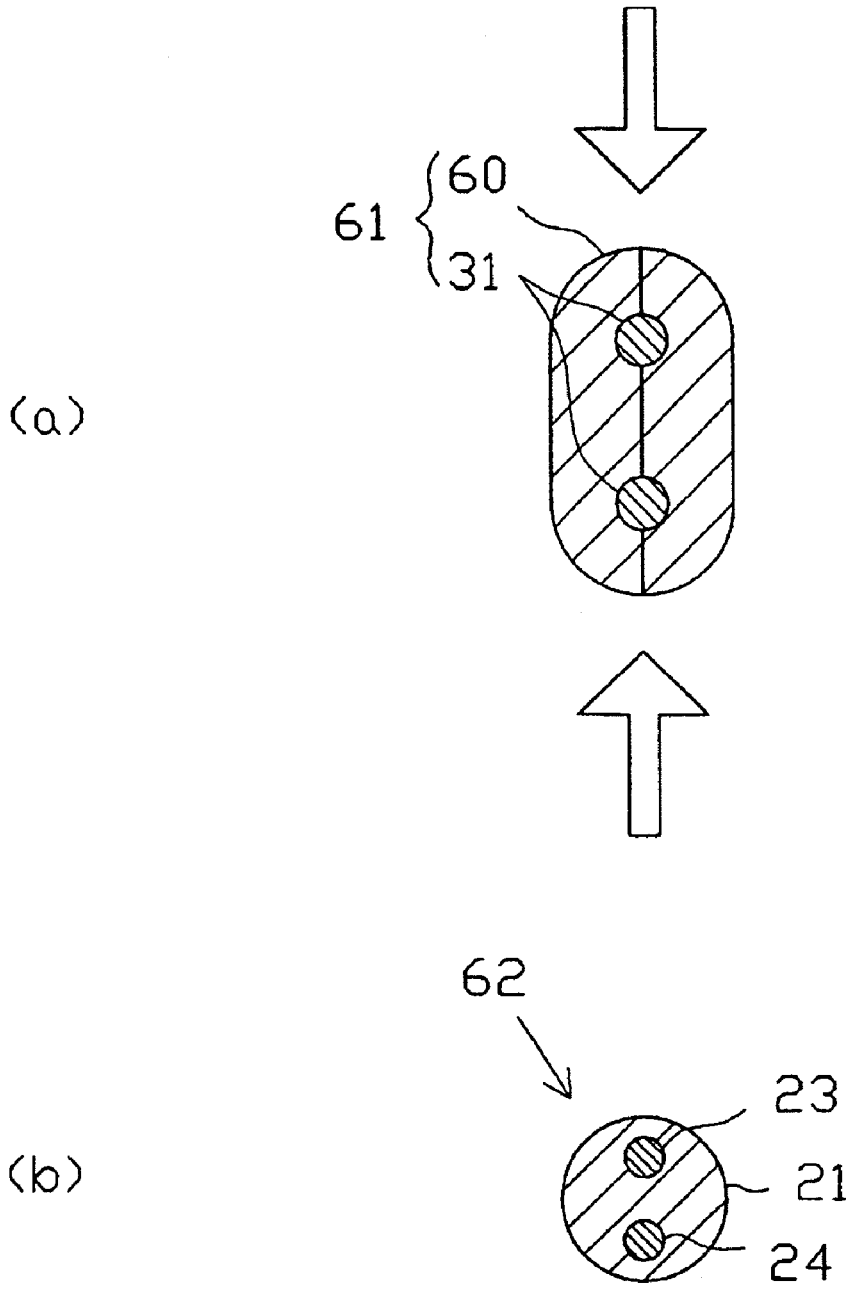
FIG. 6(*a*) is a sectional view illustrating the holder pressing direction when it is sintered.
Figure 7:
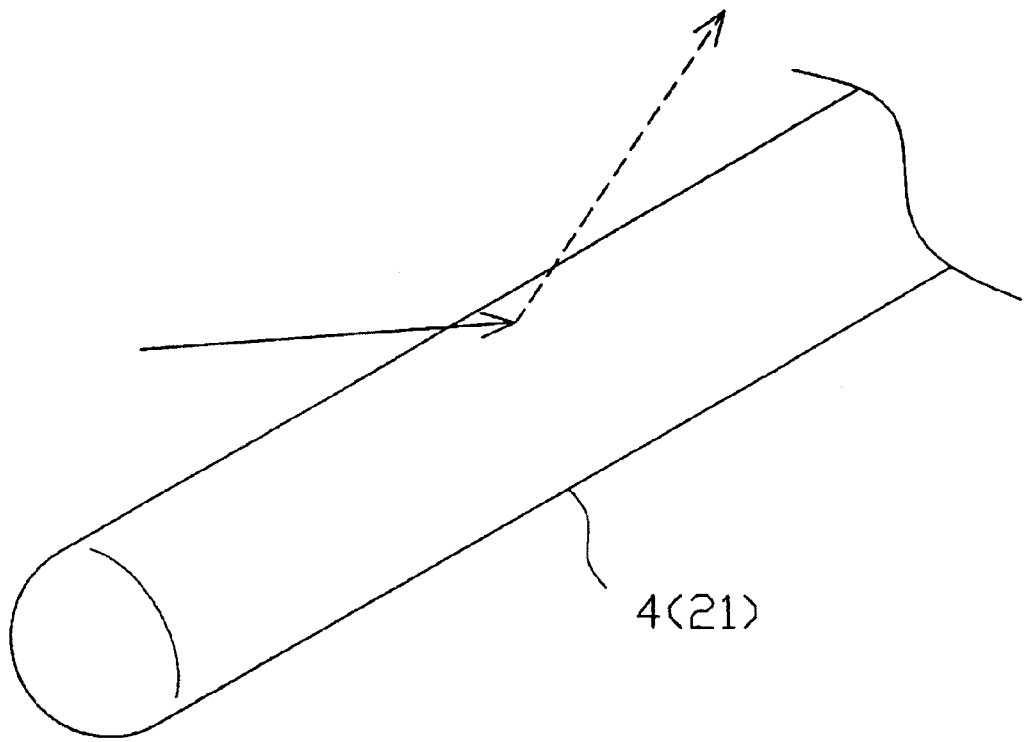
FIG. 7 is a perspective view illustrating the X-ray irradiation direction when the surface of the base is measured.

In the next step (S3 in FIG. 3), a holder 61, which is shown in FIG. 5, is formed from the molded body 31 for the heating element, the half molded body 40 for the insulator, and the insulating ceramic powder. A predetermined mold assembly (not shown in the figures) is used also to mold this holder 61. The mold assembly has, in the same way, a frame in the shape of a typical frame, and a top force and a bottom force that are movable in relation to the frame. The projecting part of the bottom force is inserted into the opening of the frame, and the half molded body 40 for the insulator is placed on the bottom force. The molded body 31 for the heating element is placed in the housing recess 48 of the half molded body 40 for the insulator. Then the opening is filled with a predetermined amount of the insulating ceramic powder. Finally, the top force is moved down and pressing under a predetermined pressure is carried out. As a result, a holder 61 made by an insulating molded body 60 and the molded body 31 for the heating element held in the former, as shown in FIG. 5, is obtained.

After the molding of the holder 61, degreasing is carried out (S4 in FIG. 3). The binder is still included in the resultant holder 61 in this stage. The holder 61 is preheated, or degreased or under a debinder treatment, at 800° C. for an hour in an atmosphere of nitrogen gas so that the binder is incinerated or removed.

Then, a mold-release agent is applied to the entire outer surface of the holder (S5 in FIG. 3), which is followed by a step of sintering the holder 61 (S6 in FIG. 3). In the latter step, sintering by the so-called hot pressing is carried out. In more detail, the holder 61 shown in FIG. 6(*a*) is pressed and heated at 1800° C. for 1.5 hours in a non-oxidizing atmosphere under a hot pressing pressure of 25 MPa with a hot pressing machine. A sintered body 62 shown in FIG. 6(*b*) is thus obtained. In the sintering furnace of the hot pressing machine, a carbon jig with a recess to correct the shape of the sintered body 62 after the sintering so that it will have the shape of a general cylinder, or a recess with the shape complementary to the outer shape of the ceramic heater 4, is used when the hot-pressing sintering is carried out. During the sintering, the holder 61 is pressed and sintered under uniaxial pressure exerted in the way shown by the arrows in FIG. 6(*a*).

After that, an end-cutting step in which the rear end of the sintered body 62 is cut away is carried out (S7 of FIG. 3). In more detail, the rear end of the molded body 62 is cut away with a cutter such as a diamond cutter. This cutting removes the supporting portion 39, and the respective ends of the lead portions 33, 34 are exposed at the cut face. This cutting is carried out so that the lead portion 23 and the lead portion 24 of the heating element 22 will not be short-circuited and to ensure that the current will certainly flow through the heating portion 26. The molded body may be cut at anyplace behind the electrode terminal 27. In summary, this cutting step makes the molded body 31 for the heating element that is composed of the connecting portion 35, lead portions 33, 34, and supporting portion 39 in the injection molding step electrically open, or not annular. Needless to say, if a molded body for the heating element without the supporting portion is obtained in the injection-molding step, this end-cutting step is not necessary.

This end-cutting step is followed by various kinds of grinding and polishing of the sintered body 62 (S7 of FIG. 3). Then, a completed body of the ceramic heater 4 is obtained. The grinding and polishing includes centreless grinding to grind the outer circumferential face of the sintered body 62 so as to make the electrode terminals 27, 28 projecting from the face with a known centreless grinding machine, and a side grinding to make the face of the front end of the base 21 round so that the distance between the heating portion 26 and the radially corresponding outer surface of the front end is uniform.

As we have explained in detail, the base 21 of the ceramic heater 4 according to this embodiment includes a rare earth element component in an amount from 4 to 25% by mass in terms of an oxide thereof, which not only improves sinterability when it is sintered, but also enhances the thermal expansion coefficient of the base 21. This enhancement reduces the difference between the thermal expansion coefficient of the heating element 22 and that of the base 21, which contributes to the prevention of cracking due to the thermal stress. When the amount of the rare earth element component in terms of an oxide thereof is less than 4% by mass, there is a probability that sintering may not take place well while the ceramic heater is being sintered. Besides, an enhancement in the thermal expansion coefficient cannot be expected, and the ceramic heater may have cracks due to thermal stress. On the other hand, when the amount of the rare earth element component in terms of an oxide thereof is more than 25% by mass, crystalline phases composed of a rare earth element (RE), silicon (Si), nitrogen (N) and oxygen (O) are formed and the existence of the crystalline phases lowers the oxidation resistance although the thermal expansion coefficient is enhanced.

The base 21 includes a silicide of chromium in an amount from 1 to 8% by mass in terms of chromium silicide. The silicide of chromium within this range increases the thermal expansion coefficient of the base 21, which leads to a reduction in the difference between the thermal expansion coefficient of the heating element 22 and that of the base 21. When the amount of the silicide of chromium is less than 1% by mass in terms of chromium silicide, an increase in the thermal expansion coefficient cannot be expected, which may cause cracking due to thermal stress. On the other hand, if the amount of the silicide of chromium exceeds 8% by mass in terms of chromium silicide, an agglomeration of chromium components may be caused. As a result, the thermal expansion coefficient of the base is not uniform in its value part by part, which may lower the strength.

The base 21 further includes an aluminum component in an amount from 0.02 to 1.0% by mass in terms of aluminum nitride, with respect to the entire base as well as the surface thereof. The aluminum component in the specified amount controls corrosion of the base 21 by corrosive components such as calcium components included in engine oil. When the amount of the aluminum component in terms of aluminum nitride is less than 0.02% by mass, the corrosion of the base 21 cannot be controlled sufficiently. On the other hand, if the amount of the aluminum component in terms of aluminum nitride exceeds 1.0% by mass, the strength of the base 21 at raised temperatures is reduced.

The base 21 of this embodiment further includes a solid solution of a silicide of chromium and a silicide of tungsten, or a solid solution of a silicide of chromium and a silicide of vanadium (CrV)Si obtained by addition of tungsten silicide or vanadium silicide to the materials for the base 21. The inclusion of such a solid solution controls agglomeration of chromium components at the interface of the heating element 22 and the base 21. As a result, the ceramic heater of this embodiment is capable of checking the thermal expansion coefficient from being not uniform over the base 21 due to the agglomeration of chromium molecules, and preventing deterioration in the strength of the base 21.

Furthermore, the base 21 of this embodiment does not have crystalline phases composed of a rare earth element, silicon, nitrogen and oxygen at the surface thereof, which arrests oxidation of the surface of the base. As a result, the resistance to oxidation can be enhanced. The base 21 also has crystalline phases of a monosilicate of a rare earth element and/or crystalline phases of a monosilicate of a rare earth element. The existence of such crystalline phases improves the heat resistance and the strength of the base at high temperatures.

In addition, the base 21 includes from 2 to 10% by volume of silicon carbide, which not only improves the sinterability when the ceramic heater is sintered, but also enlarges the thermal expansion coefficient of the base 21, which leads to a reduction in the difference between the thermal expansion coefficient of the heating element 22 and that of the base 21. When the amount of silicon carbide is less than 2% by volume, an increase in the thermal expansion coefficient can hardly be expected and the strength at high temperatures is inhibited from increasing. On the other hand, when the amount of silicon nitride exceeds 10% by volume, there is a probability that an improvement in the sinterability during the sintering may be insufficient and the insulating properties may deteriorate.

EXAMPLES

Working Example 1

In order to confirm the advantages that we have explained hereinbefore, we prepared various samples under various conditions and carried out various tests to evaluate the properties of the samples.

Silicon nitride powder with an average particle size of 0.7 μm was blended with $Er_2O_3$ as an oxide of a rare earth element, $CrSi_2$ powder with an average particle size of 1.0 μm, W compound powder, such as $WO_3.WSi_2$, with an average particle size of 1.0 μm, silicon carbide powder and silicon dioxide powder with an a crystalline structure or a β crystalline structure and with an average particle size of 1.0 μm, and aluminum compound powder composed of aluminum nitride and alumina ($AlN:Al_2O_3=3:1$). The obtained mixture was wet mixed in ethanol with balls made of silicon nitride for 40 hours. The resultant was dried in a water bath, and a powder was obtained. The obtained powder for the heater member was processed as explained hereinbefore and ceramic heaters were prepared. Separately from the ceramic heaters, or the bases thereof, plate-like sintered bodies, or test pieces, which may sometimes be abbreviated to TP(s) hereinafter, with the dimensions of 45 mm×45 mm×10 mm, were prepared through hot pressing in an atmosphere of nitrogen gas at 1800° C. under 25 MPa for 1.5 hours.

In the step above, the respective amounts of the oxide of the rare earth element ($ER_2O_3$), the silicide of chromium ($CrSi_2$), and the aluminum component were changed variously, and various ceramic heaters (elements) and test pieces were prepared. The compositions of the components of the bases were measured and the crystalline phases of the bases were observed. The amount of each component was measured in the following way: Each ceramic heater was cut at the location where the largest heat is generated. Specifically, each ceramic heater was transversely cut at a location of 4 mm from the front end thereof in this example. Then, the part around the point 100 μm under the circumferential surface of the heater on the section was measured with a wavelength-dispersive X-ray micro-analyzer operated at an acceleration voltage of 20 kV and a spot diameter of 100 μm. The respective amounts of the oxide of the rare earth element, the chromium component and the aluminum component were measured, and the measured value of the chromium component was converted into a value in terms of $CrSi_2$, and that of the aluminum component into a value in terms of AlN. The amount of each component was thus obtained.

A thermal expansion coefficient and a corrosion resistance against $CaSO_4$ at 1100° C. and 1150° C. of each test piece were evaluated. Also, a continuous service durability at high temperatures and an on-off durability of each ceramic heater were evaluated in the following way. The results are shown in Table 1.

In the column under the item "crystalline phases" in the table, "DS" means that crystalline phases of a disilicate of the rare earth element were mainly observed, "MS" means that crystalline phases of a monosilicate of the rare earth element were mainly observed, and "MS, DS" means that crystalline phases of a mixture of a monosilicate and a disilicate of the rare earth element was observed. "Melilite" means that melilite phases, and not monosilicate phases or disilicate phases, were mainly observed.

The crystalline phases of the sintered body for the base were identified by the following method. A ROTAFLEX X-ray analyzer, manufactured by Rigaku Corporation, was used as an analyzer, and the analysis conditions were: The X-ray source was CuKα1, the applied voltage was 40 kW, the current was 100 mA, the divergent slit was 1°, the scattering slit was 1°, the receiving slit was 0.3 mm, and a bent crystal monochromator was used. The incidence of the X-ray was set so as to advance parallel with the axis of the base when the axis was horizontal. The scanning mode was 2θ/θ, wherein 2θ ranges from 20° to 80°. The surface of the base was irradiated with the X-ray at regular intervals of 0.01° at a scanning speed of 6°/minute, and the intensities of the reflected rays were measured. The measured results were compared with the JCPDS cards, and crystalline phases were identified. In Table 10 below, "MS" stands for monosilicate, and "DS" for disilicate.

The thermal expansion coefficients (unit: $10^{-6}$/° C.) of the prepared test pieces were measured in the following way. The used analyzer was a model TMA-8310 analyzer manufactured by Rigaku Corporation. Measured samples were 3 mm×3 mm×15 mm pieces cut out of the bases. The samples were under the conditions where nitrogen gas flew at 200 ml/minute and the temperature was raised from room temperature (30° C.) to 1000° C. at a rate of 10° C./minute. A first length of each sample before the temperature was raised and a second length of each sample thereafter were measured. The thermal expansion coefficient was calculated from the measured values according to the following formula.

$$\text{Thermal expansion coefficient (ppm/° C.)}=[(\text{the length of a standard sample at 1000° C.})-(\text{the length of the measured sample at 1000° C.})/\{(\text{the length of the measured sample at 30° C.})-(1000°\text{ C.}-30°\text{ C.})\}]+8.45\times10^{-6} \quad (1)$$

In formula (1) above, "the length of a standard sample at 1000° C." is the length of a same-sized sample of alumina at 1000° C. whose thermal expansion coefficient at 1000° C. is $8.45\times10^{-6}$/° C., and the alumina sample was used as the standard sample. The length of the standard sample at 30° C. is considered to be the same as that of the measured sample at 30° C.

The corrosion resistance against $CaSO_4$ was measured by the following method. The test pieces were cut and sample pieces with the dimensions of 3 mm×4 mm×15 mm were prepared. Two sample pieces for each test piece were placed in aluminum crucibles respectively in which $CaSO_4$ powder had already been placed. One of the crucibles was kept at 1100° C. for 20 hours in the air, while the other was kept at 1150° C. for 20 hours in the air. Then, the sample pieces were taken out from the crucibles and sandblasted so that $CaSO_4$ powder would be removed. The reduction in the mass of each sample piece was measured. When the reduction was less than 5%, the corrosion resistance against $CaSO_4$ of the sample piece was assessed as "◎", or "excellent". When the reduction was from 5% to 10%, the assessment was "○", or "good". When the reduction was from 10% to 20%, the assessment was "Δ", or "fair". When the reduction was over 20%, the assessment was "X", or "poor".

The continuous service durability at high temperatures of each ceramic heater element was assessed in the following way. The temperature of each heater was raised so that the highest temperature of the surface of the heater was 1350° C., and then 1400° C. The current was continuously applied to the heater element so as to keep the temperatures for 1000 hours. After the termination of the current application, the value of the resistance was measured, and the change in the resistance before and after the test was calculated. Then, the heater was cut along the axis thereof, and the section was mirror-ground. The mirror-ground section was observed with an EPMA, and whether the sintering aid components, which were rare earth elements, chromium and aluminum, around the heating element moved or not was determined. The movement of the sintering aid components may sometimes be called "migration" hereinafter. When there was no change in the resistance and no migration was observed, the continuous service durability at high temperatures of the tested heater was assessed as "○", or "excellent". When there was a little change in the resistance and some migration was observed, the assessment was "Δ", or "fair". When the value of the resistance was increased by 10% or more and migration was observed, the assessment was "x", or "poor".

The on-off durability of each ceramic heater element was assessed in the following way. A voltage was applied to the heater element so that the temperature thereof increased to 1000° C. in one second from the beginning of the application. The temperature of the heater element was uninterruptedly raised to the highest temperature, 1400° C., at this rate of increase in the temperature. Then, the application of the voltage was turned off and the heater element was cooled with fans for 30 seconds. The heating and subsequent cooling was regarded as one cycle. 1000 cycles of the heating and cooling were carried out, and the value of the resistance after the completion of the 1000th cycle was measured. When the change in the resistance after the 1000th cycle was 1% or less, the on-off durability of the tested ceramic heater element was assessed as "0", or "excellent". When the change was 1% or more, the assessment was "Δ", or "fair". When breaking of wire took place within the 1000 cycles, the assessment was "X", or "poor".

TABLE 1

| Sample | Analysis Results of Bases of Heaters | | | | |
|---|---|---|---|---|---|
| | Rare earth element component | | Silicide of chromium | Aluminum component | Crystalline |
| No. | Kind | % by mass*1 | % by mass*2 | % by mass*3 | phases |
| 1 | $Er_2O_3$ | 6.0 | 1.9 | 0.00 | DS |
| 2 | $Er_2O_3$ | 6.0 | 1.9 | 0.01 | DS |
| 3 | $Er_2O_3$ | 6.0 | 1.9 | 0.02 | MS, DS |
| 4 | $Er_2O_3$ | 6.0 | 1.9 | 0.07 | MS, DS |
| 5 | $Er_2O_3$ | 6.2 | 2.1 | 0.2 | MS, DS |
| 6 | $Er_2O_3$ | 6.4 | 2.3 | 0.37 | MS, DS |
| 7 | $Er_2O_3$ | 6.4 | 2.2 | 0.62 | Ms, DS |
| 8 | $Er_2O_3$ | 6.3 | 2.3 | 0.80 | MS, DS |
| 9 | $Er_2O_3$ | 6.3 | 2.0 | 1.00 | MS, DS |
| 10 | $Er_2O_3$ | 6.0 | 2.0 | 1.50 | MS, DS |
| 11 | $Er_2O_3$ | 3.0 | 2.0 | 0.10 | DS |
| 12 | $Er_2O_3$ | 4.0 | 2.5 | 0.11 | MS, DS |
| 13 | $Er_2O_3$ | 10.0 | 2.5 | 0.09 | MS, DS |
| 14 | $Er_2O_3$ | 15.0 | 2.5 | 0.08 | MS, DS |
| 15 | $Er_2O_3$ | 16.0 | 2.5 | 0.09 | MS |
| 16 | $Er_2O_3$ | 25.0 | 2.5 | 0.07 | MS |
| 17 | $Er_2O_3$ | 27.0 | 2.5 | 0.08 | Melilite |
| 18 | $Er_2O_3$ | 6.0 | 0.7 | 0.07 | DS |
| 19 | $Er_2O_3$ | 6.1 | 1.0 | 0.09 | MS, DS |
| 20 | $Er_2O_3$ | 6.0 | 1.5 | 0.08 | MS, DS |
| 21 | $Er_2O_3$ | 5.9 | 4.0 | 0.08 | MS, DS |
| 22 | $Er_2O_3$ | 6.0 | 7.0 | 0.07 | MS, DS |
| 23 | $Er_2O_3$ | 6.0 | 8.0 | 0.09 | DS |
| 24 | $Er_2O_3$ | 6.0 | 10.0 | 0.07 | DS |

| Sample | Evaluations of TPs | | | | Evaluations of Heater Element | | |
|---|---|---|---|---|---|---|---|
| | Thermal | Corrosion resistance against $CaSO_4$ | | | Continuous service | | |
| | expansion coefficient | Reduction in the mass (%) | | | durability at high temps. | | On-off durability |
| No. | ppm/° C. | 1100° C. | 1150° C. | Assessment | 1350° C. | 1400° C. | 1400° C. |
| 1 | 3.5 | 5.6 | 30.2 | X | ○ | ○ | ○ |
| 2 | 3.5 | 3.6 | 23.8 | X | ○ | ○ | ○ |
| 3 | 3.5 | 2.2 | 11.0 | Δ | ○ | ○ | ○ |
| 4 | 3.5 | 1.3 | 7.2 | ○ | ○ | ○ | ○ |
| 5 | 3.5 | 1.5 | 4.2 | ◎ | ○ | ○ | ○ |
| 6 | 3.5 | 1.0 | 4.8 | ◎ | ○ | ○ | ○ |
| 7 | 3.6 | 1.1 | 4.0 | ◎ | ○ | ○ | ○ |
| 8 | 3.5 | 1.0 | 4.5 | ◎ | ○ | ○ | ○ |
| 9 | 3.6 | 0.9 | 3.6 | ◎ | Δ | Δ | ○ |
| 10 | 3.5 | 1.0 | 3.4 | ◎ | X | X | X |
| 11 | 3.2 | 1.8 | 6.2 | ○ | ○ | ○ | X |
| 12 | 3.4 | 2.0 | 7.5 | ○ | ○ | ○ | ○ |
| 13 | 3.5 | 1.6 | 6.8 | ○ | ○ | ○ | ○ |
| 14 | 3.7 | 1.9 | 8.2 | ○ | ○ | ○ | ○ |
| 15 | 3.8 | 2.2 | 7.0 | ○ | ○ | ○ | ○ |

TABLE 1-continued

| | | | | | | | |
|---|---|---|---|---|---|---|---|
| 16 | 4 | 1.8 | 8.2 | ○ | ○ | ○ | ○ |
| 17 | 4 | 3.2 | 9.5 | ○ | X | X | X |
| 18 | 3.2 | 2.0 | 8.2 | ○ | ○ | ○ | X |
| 19 | 3.4 | 1.1 | 9.5 | ○ | ○ | ○ | ○ |
| 20 | 3.5 | 1.3 | 8.2 | ○ | ○ | ○ | ○ |
| 21 | 3.5 | 1.5 | 8.6 | ○ | ○ | ○ | ○ |
| 22 | 3.7 | 2.0 | 7.4 | ○ | ○ | ○ | ○ |
| 23 | 3.7 | 1.2 | 8.8 | ○ | ○ | ○ | ○ |
| 24 | 3.8 | 2.0 | 9.0 | ○ | ○ | X | X |

*1% by mass in terms of the oxide of the rare earth metal
*2% by mass in terms of $CrSi_2$
*3% by mass in terms of AlN We will discuss the Nos. 1-10 samples in Table 1 that included the oxide of the rare earth element ($Er_2O_3$) in amounts from 6.0 to 6.4% by mass and the silicide of chromium in amounts from 1.9 to 2.3% by mass in terms of chromium silicide. It is understood from the table that the Nos. 3-9 samples including the Al component in amounts from 0.02 to 1.0% by mass in terms of aluminum nitride, which were working examples, were excellent in the corrosion resistance against $CaSO_4$ at 1100° C. and 1150° C.

Compared with the samples above, the Nos. 1 and 2 samples including the Al component in amounts less than 0.02% by mass in terms of aluminum nitride, which were comparative examples, were inferior in the corrosion resistance against $CaSO_4$. It is understood that the corrosion resistance against $CaSO_4$ at 1150° C. was considerably inferior especially when the aluminum content was 0.01% by mass or less in terms of aluminum nitride, although the values of the corrosion resistance at 1100° C. were not remarkably different from those of the working examples. In summary, it is obvious that the compositions of the Nos. 3-9 samples make the corrosion resistance at high temperatures such as 1150° C. extremely excellent.

On the other hand, the No. 10 sample including the aluminum component in an amount of more than 1.0% by mass in terms of aluminum nitride, which was a comparative example, saw a change in the value of the resistance at the high temperatures. It also turned out that the strength of the heater, especially the base thereof, was lowered at the high temperatures. See the data under the item of "Evaluations of Heater Element" in the table.

We will discuss the Nos. 11-17 samples in Table 1 that included the silicide of chromium in amounts from 2.0 to 2.5% by mass in terms of chromium silicide and the aluminum component in amounts from 0.07 to 0.11% by mass in terms of aluminum nitride. It is understood from the table that the Nos. 12-16 samples including the oxide of the rare earth element ($Er_2O_3$) in amounts from 4.0 to 25.0% by mass, which were working examples, were excellent in the corrosion resistance against $CaSO_4$ as well as the continuous service durability at high temperatures and the on-off durability. Compared with these working examples, it is shown that the No. 11 sample including only 3.0% by mass of the oxide of the rare earth element ($Er_2O_3$), which was a comparative example, had a low thermal expansion coefficient, 3.2, and was inferior also in the on-off durability. On the other hand, melilite phases as the crystalline phase were observed in the No. 17 sample including the oxide of the rare earth element ($Er_2O_3$) in such a large amount as 27.0% by mass, which was a comparative example. It was shown that the No. 11 sample was considerably inferior in the continuous service durability at high temperatures and the on-off durability.

We will discuss the Nos. 18-24 samples in Table 1 that included the oxide of the rare earth element ($Er_2O_3$) in amounts from 5.9 to 6.1% by mass and the aluminum component in amounts from 0.07 to 0.09% by mass in terms of aluminum nitride. It is understood from the table that the Nos. 19-23 samples including the silicide of chromium in amounts from 1.0 to 8.0% by mass in terms of chromium silicide, which were working examples, were excellent in the corrosion resistance against $CaSO_4$ as well as the continuous service durability at high temperatures and the on-off durability. Compared with these working examples, it is shown that the No. 18 sample including the silicide of chromium in an amount of only 0.7% by mass in terms of chromium silicide, which was a comparative example, had a low thermal expansion coefficient, 3.2, and was inferior also in the on-off durability at high temperatures. On the other hand, it is shown that the No. 24 sample including the silicide of chromium in such a large amount as 10.0% by mass, which was a comparative example, was inferior in the continuous service durability at 1400° C. and the on-off durability. An agglomeration of Cr at the interface of the resistor was observed with the No. 24 sample, which is considered to be the cause of the deterioration in the service durability at high temperatures.

The results of experiments when $Er_2O_3$ was used as the rare earth element component are summarized in Table 1. In order to study whether our heater elements and test pieces would bring about the same or similar results when they included other rare earth elements, we prepared and evaluated test pieces and ceramic heaters by the same methods as those explained above. The results are shown in Table 2.

TABLE 2

| Sample | Analysis Results of Bases of Heaters | | | |
|---|---|---|---|---|
| | Rare earth element component | | Silicide of chromium | Aluminum component |
| No. | Kind | % by mass*1 | % by mass*2 | % by mass*3 |
| 25 | $Er_2O_3$ | 6.4 | 2.3 | 0.08 |
| 26 | $Y_2O_3$ | 4.0 | 2.5 | 0.07 |
| 27 | $Yb_2O_3$ | 6.5 | 2.5 | 0.09 |
| 28 | $Y_2O_3$, $Yb_2O_3$ | 4.0 | 2.5 | 0.09 |

TABLE 2-continued

| | | | | | | | |
|---|---|---|---|---|---|---|---|
| 29 | $Er_2O_3$, $Yb_2O_3$ | 6.5 | | | 2.5 | | 0.08 |
| | Evaluations of TPs | | | | Evaluations of Heater Element | | |
| | Thermal | Corrosion resistance against $CaSO_4$ | | | Continuous service | | |
| Sample | expansion coefficient | Reduction in the mass (%) | | | durability at high temps. | | On-off durability |
| No. | ppm/° C. | 1100° C. | 1150° C. | Assessment | 1350° C. | 1400° C. | 1400° C. |
| 25 | 3.5 | 1.1 | 6.8 | ○ | ○ | ○ | ○ |
| 26 | 3.6 | 1.3 | 7.2 | ○ | ○ | ○ | ○ |
| 27 | 3.6 | 1.1 | 6.1 | ○ | ○ | ○ | ○ |
| 28 | 3.6 | 1.3 | 5.8 | ○ | ○ | ○ | ○ |
| 29 | 3.6 | 1.1 | 5.2 | ○ | ○ | ○ | ○ |

*1% by mass in terms of the oxide of the rare earth metal
*2% by mass in terms of $CrSi_2$
*3% by mass in terms of AlN Table 2 shows that when other oxides of rare earth elements, for example, yttrium oxide ($Y_2O_3$) in the No. 26 sample, ytterbium oxide ($Yb_2O_3$) in the No. 27 sample, a mixture of $Y_2O_3$ and $Yb_2O_3$ in the No. 28 sample, and a mixture of $Er_2O_3$ and $Yb_2O_3$ in the No. 29 sample, were used in place of $Er_2O_3$, the same advantages as those obtained with $Er_2O_3$ were achieved.

In Table 1 above, the amounts of the silicide of chromium were evaluated after the measured values were converted into values in terms of chromium silicide. This is based on the fact that the inventors of the present invention mainly used chromium silicide ($CrSi_2$) as a raw material in their process of invention. Other silicides such as tungsten silicide and vanadium silicide may be added to chromium silicide ($CrSi_2$), and the mixture may be used as the silicide of chromium. Then, we prepared and evaluated test pieces and ceramic heaters additionally including tungsten silicide or vanadium silicide that served together with chromium silicide as a silicide of chromium according to the invention, by the same methods as those explained above. The results are shown in Table 3.

The existence of a solid solution was determined by the following way: Each tested heater element was transversely cut at a part that emitted the largest heat, specifically at 4 mm from the front end of the heater element, and a sample of the section was prepared. After the section was mirror-ground, the crystalline structures of the mirror-ground section were observed with a scanning electron microscope, which is often abbreviated to SEM. Then, the particles of the silicide of chromium were identified. The particles were spot-analyzed by energy dispersive X-ray spectroscopy, which is often abbreviated to EDS, at 5000 magnifications, and an elementary analysis was carried out. When tungsten or vanadium, other than chromium and silicon, was detected as the result of the analysis, we judged that the solid solution existed in the tested heater element.

TABLE 3

| | | | | | |
|---|---|---|---|---|---|
| | Analysis Results of Bases of Heaters | | | | |
| Sample | Rare earth element component | | Silicide of chromium | Aluminum component | Kind of silicide |
| No. | Kind | % by mass*1 | % by mass*2 | % by mass*3 | of chromium |
| 30 | $Er_2O_3$ | 6.4 | 2.3 | 0.10 | Cr—W solid solution |
| 31 | $Er_2O_3$ | 6.3 | 2.0 | 0.11 | Cr—V solid solution |
| 32 | $Er_2O_3$ | 6.0 | 2.5 | 0.08 | $CrSi_2$ |

| | | | | | | | |
|---|---|---|---|---|---|---|---|
| | Evaluations of TPs | | | | Evaluations of Heater Element | | |
| | Thermal | Corrosion resistance against $CaSO_4$ | | | Continuous service | | |
| Sample | expansion coefficient | Reduction in the mass (%) | | | durability at high temps. | | On-off durability |
| No. | ppm/° C. | 1100° C. | 1150° C. | Assessment | 1350° C. | 1400° C. | 1400° C. |
| 30 | 3.6 | 1.1 | 7.0 | ○ | ○ | ○ | ○ |
| 31 | 3.5 | 1.5 | 8.0 | ○ | ○ | ○ | ○ |
| 32 | 3.5 | 1.3 | 5.8 | ○ | ○ | ○ | ○ |

*1% by mass in terms of the oxide of the rare earth metal
*2% by mass in terms of $CrSi_2$
*3% by mass in terms of AlN In Table 3, the No. 30 sample included tungsten silicide in addition to chromium silicide ($CrSi_2$), and a solid solution of a silicide of chromium and a silicide of tungsten was observed in the obtained test piece and ceramic heater. The No. 31 sample included vanadium silicide in addition to chromium silicide ($CrSi_2$) and a solid solution of a silicide of chromium and a silicide of vanadium was observed in the obtained test piece and ceramic heater. On the other hand, the No. 32 sample included only chromium silicide ($CrSi_2$) as the raw material of the silicide of chromium, and the existence of chromium silicide ($CrSi_2$) was confirmed in the obtained test piece and ceramic heater.

As understood from Table 3, the present invention does not always require the existence of pure chromium silicide ($CrSi_2$). It was shown that the solid solution of the silicides of chromium and tungsten and that of the silicides of chromium and vanadium provided the same advantages. Also, the inclusion of such solid solutions means that an agglomeration of chromium components at the interface of the heating element and the base did not take place so much. Generally, the inclusion of tungsten silicide or vanadium silicide in addition to chromium silicide ($CrSi_2$) at the stage of the preparation of raw materials results in the formation of a solid solution. Ceramic heaters including the solid solution are capable of checking the thermal expansion coefficient from being not uniform over the base due to the agglomeration of chromium components, and preventing deterioration in the strength of the base.

As understood from the results shown in Tables 1, 2 and 3, the base of a ceramic heater that includes as raw materials a rare earth element component in an amount from 4 to 25% by mass in terms of an oxide thereof, a silicide of chromium in an amount from 1 to 8% by mass in terms of chromium silicide, and an aluminum component in an amount from 0.02 to 1.0% by mass in terms of aluminum nitride is capable of enhancing the thermal expansion coefficient thereof. It was also revealed that ceramic heaters employing the base were excellent in the continuous service durability at high temperatures and the On-off durability.

Next, in order to reveal influence of the silicon carbide content of the base, we prepared samples that included various amounts of silicon carbide and the almost the same amounts of an oxide of a rare earth element, which was $Er_2O_3$, a silicide of chromium, and an Al component. Then, we evaluated the prepared with respect to the thermal expansion coefficient and the on-off durability. The results are shown in Table 4. The amount of silicon carbide included in the base was measured in the following way: Each tested heater element was transversely cut at a part that emitted the largest heat, specifically at 4 mm from the front end of the heater element, and a sample of the section was prepared. After the section was mirror-ground, the crystalline structures of the mirror-ground section were observed with a scanning electron microscope, which is often abbreviated to SEM. Then, particles of silicon carbide were identified, and the volumetric percentage of the silicon carbide particles was obtained from the area percentage thereof.

TABLE 4

| Sample | Analysis Results of Bases of Heaters | | | | |
|---|---|---|---|---|---|
| | Rare earth element component | | Silicide of chromium | Aluminum component | Silicon carbide |
| No. | Kind | % by mass*1 | % by mass*2 | % by mass*3 | % by vol. |
| 33 | $Er_2O_3$ | 6.0 | 2.1 | 0.09 | 0 |
| 34 | $Er_2O_3$ | 6.0 | 2.0 | 0.10 | 2.0 |
| 35 | $Er_2O_3$ | 6.2 | 2.0 | 0.09 | 4.9 |
| 36 | $Er_2O_3$ | 6.1 | 1.9 | 0.09 | 10.0 |
| 37 | $Er_2O_3$ | 6.0 | 2.0 | 0.08 | 13.1 |

TABLE 4-continued

| Sample No. | Evaluations of TPs Thermal expansion coefficient ppm/° C. | Evaluations of Heater Element On-off durability 1400° C. |
|---|---|---|
| 33 | 3.4 | ○ |
| 34 | 3.5 | ○ |
| 35 | 3.6 | ○ |
| 36 | 3.6 | ○ |
| 37 | 3.7 | Δ |

*1% by mass in terms of the oxide of the rare earth metal
*2% by mass in terms of $CrSi_2$
*3% by mass in terms of AlN We will discuss the Nos. 33-37 samples in Table 4 that included the oxide of the rare earth element ($Er_2O_3$) in amounts from 6.0 to 6.2% by mass, the silicide of chromium in amounts from 1.9 to 2.1% by mass in terms of chromium silicide, and the aluminum component in amounts from 0.08 to 0.10% by mass in terms of aluminum nitride. It is shown from the results of these samples that the thermal expansion coefficient increased as the amount of silicon carbide increased. In other words, the inclusion of a predetermined amount of silicon carbide enhances the thermal expansion coefficient of the base, which leads to a reduction in the difference between the thermal expansion coefficient of the heating element and that of the base. On the other hand, the No. 37 sample including silicon carbide in an amount more than 10% by volume, specifically 13.1% by volume was inferior also in the on-off durability.

We have already explained that the base has to include an aluminum component in an amount from 0.02 to 0.1% by mass in terms of aluminum nitride based on the evaluations herein before such as the data summarized in Table 1. Concerning the aluminum component, we also compared a base including alumina ($Al_2O_3$) only as a raw material and a base including mainly aluminum nitride (AlN) with alumina ($Al_2O_3$) also added, an example of which was a mixture of AlN and $Al_2O_3$ in the ratio of the mass of the former to that of the latter of 3, with respect to strength properties at such high temperatures as 1400° C. The results are shown in Table 5. The "hot bending test at 1400° C." was carried out in the following way: Test pieces with the dimensions of 3 mm×4 mm×40 mm were prepared by the same method as that explained above. The four-point bending strengths of the test pieces were measured at 1400° C. according to JIS 1604, with an upper span of 10 mm and a lower span of 30 mm.

TABLE 5

| Method of adding Al | Added amount/ % by mass | | Hot bending strength at 1400° C. (MPa) |
|---|---|---|---|
| | AlN | $Al_2O_3$ | |
| AlN—$Al_2O_3$ | 0.6 | 0.2 | 639 |
| $Al_2O_3$ | 0 | 0.8 | 475 |

The results in Table 5 show that the employment of AlN as a main component provides a higher hot bending strength at 1400° C. that the employment of $Al_2O_3$ only. Generally, the addition of the aluminum component in the form of a mixture of $Al_2O_3$ and AlN is preferred to the addition of $Al_2O_3$ only. The ratio of the mass of AlN to that of $Al_2O_3$ should be 3 or more. This constitution achieves a large hot bending strength of 600 MPa or more, 639 MPa in this example, in measurement of the four-point bending strength at 1400° C. according to JIS 1604.

Example 2

Silicon nitride powder with an average particle size of 0.7 μm was blended with $Er_2O_3$ as an oxide of a rare earth element, $CrSi_2$ powder with an average particle size of 1.0 μm, W compound powder, such as $WO_3.WSi_2$, with an average particle size of 1.0 μm, silicon carbide powder with an α crystalline structure or a β crystalline structure, and aluminum compound power composed of aluminum nitride and alumina ($AlN:Al_2O_3$=3:1). The obtained mixture was wet mixed in ethanol with balls made of silicon nitride for 40 hours. The resultant was dried in a water bath, and a powder was obtained. The obtained powder for the heater member was processed as explained hereinbefore and ceramic heaters were prepared. Separately from the ceramic heaters, or the bases thereof, plate-like sintered bodies, or test pieces, which may sometimes be abbreviated to TP(s) hereinafter, were prepared through hot pressing in an atmosphere of nitrogen gas at 1800° C. under 25 MPa for 1.5 hours by the same method as in Example 1.

The amounts of the oxide of the rare earth element, the chromium component and the aluminum component were measured by the same methods as in Example 1. The amounts of the chromium component were converted to values in terms of $CrSi_2$, and the amounts of the aluminum component to values in terms of AlN. The amounts of silicon carbide were determined by the same method as in Example 1. The corrosion resistance, the thermal expansion coefficient and the on-off durability of the samples were also measured and evaluated in the same ways as in Example 1. The results are shown in Table 6.

The following was employed as the method of measuring the maximum particle size of silicon carbide particles in the surface portion of each sample: A transverse section of the base taken at a part near the front end thereof, which emits the largest heat, was mirror-ground. The grain structures of arbitrarily selected ten spots in the area within 100 μm from the surface of the mirror-ground part of the base were observed with a scanning electron microscope, which is often abbreviated to SEM, at 3000 magnifications. Then, the particles of silicon carbide were identified, and the maximum diameter of the identified particles was regarded as the maximum particle size.

In Table 6, the assessments of the corrosion resistance against $CaSO_4$ are shown according to the following criteria: When the reduction in the mass of a sample piece was less than 5%, the corrosion resistance of the sample piece was assessed as "◎", or "excellent". When the reduction was from 5% to 10%, the assessment was "○", or "good". When the reduction was from 10% to 20%, the assessment was "Δ", or "fair". When the reduction was over 20%, the assessment was "X", or "poor".

The on-off durability of the ceramic heater elements was measured by the same method as in Example 1. The results of the measurement are shown in Table 6. In this table, the assessments of the property in question are shown according to the following criteria: When the change in the resistance after the 1000th cycle was 1% or less, the on-off durability of the tested ceramic heater element was assessed as "○", or "excellent". When the change was 1% or more, the assessment was "Δ", or "fair". When breaking of wire took place within the 1000 cycles, the assessment was "X", or "poor".

TABLE 6

| | Analysis Results of Bases of Heaters | | | | | | |
|---|---|---|---|---|---|---|---|
| | | | | | Silicon carbide | | |
| Sample | Rare earth element component | | Silicide of chromium | Aluminum comPonent | Amount | Particle size of raw material | Maximum Particle size |
| No. | Kind | wt % | wt %*1 | wt %*2 | vol % | (μm) | (μm) |
| 38 | $Er_2O_3$ | 7.2 | 2.2 | 0.31 | 5.9 | 0.5 | 1.6 |
| 39 | $Er_2O_3$ | 7.2 | 2.0 | 0.30 | 5.8 | 3.0 | 8.8 |
| 40 | $Er_2O_3$ | 7.2 | 2.1 | 0.30 | 6.0 | 5.8 | 18.8 |

| | Evaluations of TPs | | | | |
|---|---|---|---|---|---|
| | Corrosion resistance against $CaSO_4$ | | | Thermal | Evaluations of Heater Element |
| Sample | Reduction in the mass (%) | | | expansion coefficient | On-off durability |
| No. | 1100° C. | 1150° C. | Assessment | $10^{-6}$/° C. | 1400° C. |
| 38 | 1.1 | 4.5 | ◎ | 3.6 | ○ |
| 39 | 1.8 | 7.0 | ○ | 3.6 | ○ |
| 40 | 2.0 | 12.2 | Δ | 3.6 | ○ |

*1wt % in terms of $CrSi_2$
*2wt % in terms of AlN

As obvious from Table 6, when the maximum particle size of the silicon carbide particles exceeded 15 μm, the corrosion resistance deteriorated.

Example 3

We will show the relationship between the particle size of a silicide of chromium and the corrosion resistance of the prepared test pieces.

Silicon nitride powder with an average particle size of 0.7 μm was blended with erbium oxide, which may sometimes be expressed by $Er_2O_3$ hereinafter, as an oxide of a rare earth element; chromium compound powder, specifically chromium silicide ($CrSi_2$) powder, wherein powders with different particle sizes were used in the samples as shown in Table 7; tungsten compound powder, specifically, $WO_3.WSi_2$, and vanadium compound powder, specifically, $V_2O_5$ and/or $VSi_2$; aluminum compound power composed of aluminum nitride and alumina ($AlN:Al_2O_3$=3:1); and silicon dioxide powder. The obtained mixture was wet mixed in ethanol with balls made of silicon nitride for 40 hours. The resultant was dried in a water bath, and a powder was obtained. The obtained powder for the heater member was processed as explained hereinbefore and ceramic heaters were prepared. Separately from the ceramic heaters, or the bases thereof, plate-like sintered bodies, or test pieces, which may sometimes be abbreviated to TP(s) hereinafter, were prepared through hot pressing in an atmosphere of nitrogen gas at 1800° C. under 25 MPa for 1.5 hours by the same method as in Example 1.

The thermal expansion coefficients of these bases were measured by the same method as in Example 1. The results of the measurement are shown in Table 7. The properties of the powders of the silicide of chromium were measured by the same methods as in Example 2.

The corrosion resistance against $CaSO_4$ was evaluated by the same method as in Example 1. The results of the evaluation are shown in Table 7. In this table, the assessments of the corrosion resistance against $CaSO_4$ are shown according to the following criteria. When the reduction in the mass of a sample piece was less than 5%, the corrosion resistance of the sample piece was assessed as "◎", or "excellent". When the reduction was from 5% to 10%, the assessment was "○", or "good". When the reduction was from 10% to 20%, the assessment was "Δ", or "fair". When the reduction was over 20%, the assessment was "X", or "poor".

The continuous service durability at high temperatures of the ceramic heater elements was evaluated by the same method as in Example 1. The results of the evaluation are shown in Table 7. In this table, the assessments of the continuous service durability at high temperatures are shown according to the following criteria. When there was no change in the resistance and no migration was observed, the continuous service durability at high temperatures of the tested heater was assessed as "○", or "excellent". When there was a little change in the resistance and some migration was observed, the assessment was "Δ", or "fair". When the value of the resistance was increased by 10% or more and migration was observed, the assessment was "X", or "poor".

The on-off durability of the ceramic heater elements was evaluated by the same method as in Example 1. The results of the evaluation are shown in Table 7. In this table, the assessments of the property in question are shown according to the following criteria: When the change in the resistance after the 1000th cycle was very little, the on-off durability of the tested ceramic heater element was assessed as "○", or "excellent". When the change was observed, the assessment was "Δ", or "fair". When breaking of wire took place within the 1000 cycles, the assessment was "X", or "poor".

TABLE 7

| | Analysis Results of Bases of Heaters | | | | | | |
|---|---|---|---|---|---|---|---|
| | | | | | Silicide | | |
| Sample | Oxide of rare earth element | | Chromium component | Aluminum component | | Particle size of raw material | Maximum Particle size |
| No. | Kind | wt % | wt %*1 | wt %*2 | Kind | (μm) | (μm) |
| 41 | $Er_2O_3$ | 6.4 | 2.5 | 0.10 | Cr—W SS*3 | 1.0 | 9.9 |
| 42 | $Er_2O_3$ | 6.5 | 2.5 | 0.10 | Cr—W SS*3 | 3.5 | 13.4 |
| 43 | $Er_2O_3$ | 6.4 | 2.4 | 0.10 | Cr—W SS*3 | 5.1 | 16.5 |
| 44 | $Er_2O_3$ | 6.3 | 2.0 | 0.11 | Cr—V SS*3 | 1.0 | 8.3 |
| 45 | $Er_2O_3$ | 6.3 | 2.2 | 0.10 | Cr—V SS*3 | 3.5 | 12.5 |
| 46 | $Er_2O_3$ | 6.4 | 2.1 | 0.10 | Cr—V SS*3 | 5.5 | 17.0 |
| 47 | $Er_2O_3$ | 6.0 | 2.5 | 0.08 | $CrSi_2$ | 1.0 | 8.5 |

| | Evaluations of TPs | | | | Evaluations of Heater Element | | |
|---|---|---|---|---|---|---|---|
| | Thermal | Corrosion resistance against $CaSO_4$ | | | Continuous service | | |
| Sample | expansion coefficient | Reduction in the mass (%) | | | durability at high temps. | | On-off durability |
| No. | $10^{-6}$/° C. | 1100° C. | 1150° C. | Assessment | 1350° C. | 1400° C. | 1400° C. |
| 41 | 3.6 | 1.1 | 4.8 | ◎ | ○ | ○ | ○ |
| 42 | 3.5 | 1.1 | 8.1 | ○ | ○ | ○ | ○ |
| 43 | 3.5 | 1.5 | 12.1 | Δ | ○ | ○ | ○ |
| 44 | 3.5 | 1.5 | 8.0 | ○ | ○ | ○ | ○ |
| 45 | 3.4 | 1.2 | 9.2 | ○ | ○ | ○ | ○ |
| 46 | 3.5 | 1.4 | 12.5 | Δ | ○ | ○ | ○ |
| 47 | 3.5 | 1.3 | 5.8 | ○ | ○ | ○ | ○ |

*1wt % in terms of $CrSi_2$
*2wt % in terms of AlN
*3"SS" stands for solid solution.

As clearly understood from the results summarized in Table 7, the sample bases including the particles of the silicides of chromium with a maximum particle size of more than 15 μm were inferior in the corrosion resistance.

Example 4

The relationship between the porosity of a base and the properties of the base and ceramic heater was revealed in Example 4.

Silicon nitride powder with an average particle size of 0.7 μm was blended with erbium oxide, which may sometimes be expressed by $Er_2O_3$ hereinafter, as an oxide of a rare earth element; chromium compound powder, specifically chromium oxide and chromium silicide ($Cr_2O_3.CrSi_2$) powder, with an average particle size of 1.0 μm; tungsten compound powder, specifically, $WO_3.WSi_2$ powder, with an average particle size of 1.0 μm; aluminum compound power composed of aluminum nitride and alumina ($AlN:Al_2O_3=3:1$); and carbon powder to form pores. The obtained mixture was wet mixed in ethanol with balls made of silicon nitride for 40 hours. The resultant was dried in a water bath, and a powder was obtained. The obtained powder for the heater member was processed as explained hereinbefore and ceramic heaters were prepared. Separately from the ceramic heaters, or the bases thereof, plate-like sintered bodies, or test pieces, which may sometimes be abbreviated to TP(s) hereinafter, were prepared through hot pressing in an atmosphere of nitrogen gas at 1800° C. under 25 MPa for 1.5 hours by the same method as in Example 1.

The base of the No. 48 sample and that of the No. 30 sample in Example 1 were measured and evaluated with respect to the corrosion resistance by the same methods as those hereinbefore, and the obtained ceramic heaters were measured and evaluated with respect to the continuous service durability at high temperatures and the on-off durability by the same methods as those hereinbefore as well. The thermal expansion coefficient was measured by the same method as in Example 1. The results of the measurements are shown in Table 8. The amount of the silicide of chromium included in each base was measured by the same method as in Example 2. The porosity was measured in the following way: A transverse section of the tested ceramic heater taken at a part near the front end thereof, which emitted the largest heat, was mirror-ground. The grain structures of arbitrarily selected ten spots in the area within 100 μm from the surface of the mirror-ground part of the ceramic heater were observed with a scanning electron microscope, which is often abbreviated to SEM, at 3000 magnifications. The volumetric percentage of the pores was obtained from the ratio of the area of the pores in the observed face to that of the observed face. The volumetric percentage was regarded as an index of the porosity.

In Table 8, the assessments of the porosity are shown according to the following criteria: When the porosity was 5% or less, the assessment was "○", or "good". When the porosity was over 5% to 10%, the assessment was "Δ", or "fair". When the porosity was over 10%, the assessment was "x", or "poor".

In Table 8, the assessments of the corrosion resistance are shown according to the following criteria: When the reduction in the mass of a sample piece was less than 5%, the corrosion resistance of the tested sample piece was assessed as "◎", or "excellent". When the reduction was from 5% to 10%, the assessment was "○", or "good". When the reduction was from 10% to 20%, the assessment was "Δ", or "fair". When the reduction was over 20%, the assessment was "X", or "poor".

In Table 8, the assessments of the continuous service durability for 1000 hours at high temperatures are shown according to the following criteria. When there was no change in the resistance and no migration was observed, the durability of the tested heater was assessed as "○", or "excellent". When there was a little change in the resistance and some migration was observed, the assessment was "Δ", or "fair". When the value of the resistance was increased by 10% or more and migration was observed, the assessment was "X", or "poor".

The on-off durability of the ceramic heater elements was evaluated by the same method as in Example 1. The results of the evaluation are shown in Table 8. In this table, the assessments of the property in question are shown according to the following criteria: When the change in the resistance after the 1000th cycle was less than 1%, the on-off durability of the tested ceramic heater element was assessed as "○", or "excellent". When the change after the 1000th cycle was 1% or more, the assessment was "Δ", or "fair". When breaking of wire took place within the 1000 cycles, the assessment was"X", or "poor".

TABLE 8

| | Analysis Results of Bases of Heaters | | | | | |
|---|---|---|---|---|---|---|
| Sample | Oxide of rare earth element | | Chromium component | Aluminum component | Silicide | Porosity |
| No. | Kind | wt % | wt %*1 | wt %*2 | Kind | (%) |
| 30 | $Er_2O_3$ | 6.4 | 2.3 | 0.10 | Cr—W SS*3 | ○ |
| 48 | $Er_2O_3$ | 6.4 | 2.4 | 0.09 | Cr—W SS*3 | Δ |

| | Evaluations of TPs | | | | Evaluations of Heater Element | | |
|---|---|---|---|---|---|---|---|
| | Thermal | Corrosion resistance against $CaSO_4$ | | | Continuous service | | |
| Sample | expansion coefficient | Reduction in the mass (%) | | | durability at high temps. | | On-off durability |
| No. | $10^{-6}$/° C. | 1100° C. | 1150° C. | Assessment | 1350° C. | 1400° C. | 1400° C. |
| 30 | 3.6 | 1.1 | 7.0 | ○ | ○ | ○ | ○ |
| 48 | 3.6 | 1.8 | 13.1 | Δ | ○ | ○ | ○ |

*1wt % in terms of $CrSi_2$
*2wt % in terms of AlN
*3"SS" stands for solid solution.

As clearly understood from the results in Table 8, a porosity of not more than 5% improves the corrosion resistance.

Example 6

In this example, another set of test pieces and bases for heaters was prepared. The preparation steps, measurements and evaluations were the same as those in Example 5, except that the ratio of the oxygen content of the rare earth element component to the total oxygen content in the base was varied and the amounts of the other materials other than the oxygen content were not changed largely. Seven sample bases with different oxygen contents of the rare earth element component were prepared, and the measurements and evaluations were carried out. The sample bases were numbered from 49 to 55. The Nos. 49 and 50 samples were not subjected to oxidation treatment so as to have small total oxygen contents. The results of the tests and evaluations of Example 6 are shown in Table 9.

The oxygen content (% by mass) of the rare earth element component included in each sintered base was measured in the following way: When the amount of the rare earth element component was measured by the method explained above and the measured values was converted to a value in terms of an oxide of the rare earth element, the amount of oxygen included in the oxide was regarded as the oxygen content of the rare earth element component.

The total amount (% by mass) of oxygen included in each sintered base prepared in this example was measured in the following way: As the analyzer was used a high sensitivity non dispersive infrared analyzer (model: EMGA-650) manufactured by HORIBA, Ltd. The bases were ground in mortars and obtained powders were used as samples to be analyzed. Oxygen gas was extracted by the method of an inner gas fusion in an impulse furnace in a flow of an inert gas (helium gas), the extracted oxygen gas was converted to carbon monoxide gas, and the amount of the carbon monoxide gas carried by helium gas was measured with the high sensitivity non-dispersive infrared analyzer.

TABLE 9

| Analysis Results of Bases of Heaters | | | | | | | |
|---|---|---|---|---|---|---|---|
| Sample | Oxide of rare earth element | | Aluminum component | Silicide | Total oxygen content | | Crystal-line |
| No. | Kind | wt % | wt %*1 | wt %*2 | wt % | Ratio*3 | phases |
| 49 | $Er_2O_3$ | 6.9 | 0.11 | 2.7 | 1.4 | 0.62 | Melilite |
| 50 | $Er_2O_3$ | 6.9 | 0.1 | 4.4 | 1.7 | 0.51 | MS, DS |
| 51 | $Er_2O_3$ | 6.6 | 0.12 | 4.4 | 2 | 0.41 | MS, DS |
| 52 | $Er_2O_3$ | 6.5 | 0.11 | 4.4 | 2.2 | 0.37 | MS, DS |
| 53 | $Er_2O_3$ | 6.6 | 0.11 | 4.3 | 2.4 | 0.35 | DS |
| 54 | $Er_2O_3$ | 6.2 | 0.11 | 4.3 | 2.6 | 0.30 | DS |
| 55 | $Er_2O_3$ | 6.5 | 0.99 | 4.3 | 2.8 | 0.29 | DS |

| | Evaluations of TPs | | | | Evaluations of Heater Element | | |
|---|---|---|---|---|---|---|---|
| | Thermal | Corrosion resistance against $CaSO_4$ | | | Continuous service | | |
| Sample | expansion coefficient | Reduction in the mass (%) | | | durability at high temps. | | On-off durability |
| No. | $10^{-6}$/° C. | 1100° C. | 1150° C. | Assessment | 1350° C. | 1400° C. | 1400° C. |
| 41 | 3.5 | 0.6 | 4 | ◎ | 11% | 13% | 505 times |
| 42 | 3.5 | 0.6 | 4.1 | ◎ | 1% or less | 1% or less | 1000 hrs. or more |
| 43 | 3.5 | 0.6 | 4 | ◎ | 1% or less | 1% or less | 1000 hrs. or more |
| 44 | 3.5 | 0.6 | 4.1 | ◎ | 1% or less | 1% or less | 1000 hrs. or more |
| 45 | 3.5 | 0.6 | 4 | ◎ | 1% or less | 1% or less | 1000 hrs. or more |
| 46 | 3.4 | 0.6 | 4.2 | ◎ | 2% | 3% | 1000 hrs. or more |
| 47 | 3.3 | 0.6 | 4 | ◎ | 3% | 11% | 805 times |

*1wt % in terms of AlN
*2wt % in terms of $CrSi_2$
*3The ratio of the oxygen content of the rare earth element component to the total oxygen content in the sample base.

The present invention is not limited to the embodiment described hereinbefore and may be implemented in other ways such as those described in the followings.

(a) In the preceding examples, alumina was added to powdery raw materials for the holder 61 (or base 21). The alumina was nitrided during the sintering. Therefore alumina may not be added to the raw materials and only aluminum nitride may be added thereto as the aluminum component. Alternatively, aluminum nitride may not be added to the raw materials and only alumina may be added there to as the aluminum component. However, the addition of a large amount of alumina forms liquid phases at temperatures from 1350° C. to 1400° C., and there is a probability that the strength at high temperatures may deteriorate. From this viewpoint, aluminum nitride should preferably be added to the raw materials, as we mentioned that associated with the results in Table 5.

(b) The ceramic heater 4 in the embodiment is formed in the shape of a round bar whose transverse section is a circle. However, the transverse section of a ceramic heater does not have to be a circle; it may be an ellipse, an elongated circle, or a polygon. Also, several insulating bases, each in the shape of a plate, may be produced, and the heating element may be sandwiched between them so that the so-called plate heater will be made.

(c) In the embodiment above, the transverse section of the holder 61 is in the shape of a general elongated circle. However, the transverse section may be in the shape of a circle, square, or polygon.

(d) In the embodiment, half molded insulating bodies 40 are formed first, and then the holder 61 is formed from them. However these steps may be omitted and a holder may be prepared by such a press molding that a powder including an insulating ceramic as a main component inside which the heating element 31 is placed is molded in one step.

(e) In the embodiment above, the molded body 31 for the heating element is preheated and dried. However, the preheating may be omitted.

(f) The ceramic heater may also serve as a temperature sensor to detect a temperature when a change in the thermal resistivity of the heating element is read as a change in the voltage. In other words, the base of the present invention may be used for the base of a temperature sensor.

Concerning the preparation of the test pieces (TPs) and ceramic heaters, the raw materials were wet mixed in ethanol. Needless to say, ethanol may be replaced with water. Also, other methods such as spray drying may be employed in place of drying in a water bath. TPs do not have to be molded so precisely as ceramic heaters. Therefore the addition of a binder and the removal thereof may be omitted, according to circumstances.

We claim:

1. A ceramic heater having a heating element including at least one substance selected from the group consisting of silicides, nitrides and carbides of molybdenum and silicides, nitrides and carbides of tungsten as a main component, and a base mainly containing silicon nitride in which the heating element is embedded, wherein the base includes:

a rare earth element component in an amount from 4 to 25% by mass in terms of an oxide thereof;

a silicide of chromium in an amount from 1 to 8% by mass in terms of chromium silicide; and an aluminum component in an amount from 0.02 to 1.0% by mass in terms of aluminum nitride.

2. The ceramic heater according to claim 1, wherein the aluminum component is included in an amount from 0.2 to 1.0% by mass in terms of aluminum nitride.

3. The ceramic heater according to claim 1, wherein the base includes at least one of a silicide of chromium; a solid solution of a silicide of chromium and a silicide of tungsten; a solid solution of a silicide of chromium and a silicide of molybdenum; and a solid solution of a silicide of chromium and a silicide of vanadium.

4. The ceramic heater according to claim 1, wherein a maximum particle size of the silicide of chromium at the surface portion of the base is 15 μm or less.

5. The ceramic heater according to claim 1, wherein the substrate has a porosity of 5% or less.

6. The ceramic heater according to claim 1, wherein a ratio of the oxygen content of the rare earth element component to the total oxygen content in the base is from 0.3 to 0.6.

7. The ceramic heater according to claim 1, wherein crystalline phases composed of a rare earth element, silicon, nitrogen and oxygen do not exist on the surface of the base.

8. The ceramic heater according to claim 1, wherein at least one of crystalline phases of a monosilicate of a rare earth element and crystalline phases of a disilicate of a rare earth element exists in the base.

9. The ceramic heater according to claim 1, wherein the base includes from 2 to 10% by volume of silicon carbide.

10. The ceramic heater according to claim 9, wherein a maximum particle size of the particles of silicon carbide included in the base is not more than 15 μm.

11. The ceramic heater according to claim 1, wherein the base has a thermal expansion coefficient from $3.3\times10^{-6}/°$ C. to $4.0\times10^{-6}/°$ C.

12. A glow plug having a ceramic heater according to claim 1.

* * * * *